US008167716B2

(12) United States Patent
Kato et al.

(10) Patent No.: US 8,167,716 B2
(45) Date of Patent: May 1, 2012

(54) GAMING MACHINE HAVING A PLURALITY OF TERMINALS AND PLAYING METHOD THEREOF

(75) Inventors: Yoichi Kato, Tokyo (JP); Arata Ajiro, Tokyo (JP); Kenta Sugano, Tokyo (JP)

(73) Assignee: Universal Entertainment Corporation, Tokyo (JP)

( * ) Notice: Subject to any disclaimer, the term of this patent is extended or adjusted under 35 U.S.C. 154(b) by 799 days.

(21) Appl. No.: 12/240,828

(22) Filed: Sep. 29, 2008

(65) Prior Publication Data

US 2009/0305763 A1 Dec. 10, 2009

Related U.S. Application Data

(60) Provisional application No. 61/058,817, filed on Jun. 4, 2008.

(51) Int. Cl.
*A63F 9/24* (2006.01)

(52) U.S. Cl. ..... 463/31; 463/30

(58) Field of Classification Search ..... 463/31
See application file for complete search history.

(56) References Cited

U.S. PATENT DOCUMENTS 4,283,709 A 8/1981 Lucero et al.
5,820,459 A 10/1998 Acres et al.
5,938,200 A * 8/1999 Markowicz et al. ..... 273/246
6,003,013 A 12/1999 Boushy et al.
6,142,872 A 11/2000 Walker et al.
6,312,332 B1 11/2001 Walker et al.
6,361,441 B1 3/2002 Walker et al.
6,450,889 B1 * 9/2002 Mendes, Jr. ..... 463/59
6,733,390 B2 5/2004 Walker et al.
6,734,833 B1 * 5/2004 Bartosik ..... 345/4
2002/0042296 A1 4/2002 Walker et al.
2006/0166731 A1 * 7/2006 Yoshimi et al. ..... 463/20

* cited by examiner

*Primary Examiner* — David L Lewis
*Assistant Examiner* — Werner Garner
(74) *Attorney, Agent, or Firm* — Sheppard, Mullin, Richter & Hampton LLP

(57) ABSTRACT

A gaming machine includes: a plurality of gaming terminals, a shared display, and a plurality of routs. Each of the gaming terminals has first light emitting portions which provide an effect to a game. Further, each of the gaming terminal runs a base game and a special game configured to award a special payout. Each of the routs is formed by arranging second light emitting portions from associated one of the gaming terminal to the shared display. The gaming machine thus structured executes a playing method including the steps of: every time a gaming terminal achieves a predetermined winning in the special game, (i) blinking a predetermined number of second light emitting portions forming a rout associated with that gaming terminal sequentially from the one closest to that gaming terminal, the predetermined number being determined based on the winning having been achieved, and (ii) blinking the first light emitting portions of that gaming terminal in sync with the second light emitting portions; and awarding a special payout to a gaming terminal whose associated rout has all its second light emitting portions being activated up to the shared display.

6 Claims, 26 Drawing Sheets

FIG. 8

| | ARRANGEMENT AREAS 151 | ARRANGEMENT AREAS 152 | ARRANGEMENT AREAS 153 | ARRANGEMENT AREAS 154 | ARRANGEMENT AREAS 155 |
|---|---|---|---|---|---|
| CODE NO. | SYMBOL | SYMBOL | SYMBOL | SYMBOL | SYMBOL |
| 00 | Coelacanth | Q | Q | Tuna | J |
| 01 | J | Tuna | Clownfish | Coelacanth | Q |
| 02 | Coelacanth | Q | Coelacanth | J | Coelacanth |
| 03 | A | Tuna | Q | Angelfish | Tuna |
| 04 | Coelacanth | J | A | Tuna | Q |
| 05 | J | Coelacanth | J | A | K |
| 06 | Coelacanth | A | Coelacanth | Q | Coelacanth |
| 07 | A | Clownfish | Angelfish | K | Q |
| 08 | K | Tuna | A | J | A |
| 09 | Clownfish | Q | Angelfish | Coelacanth | Tuna |
| 10 | Coelacanth | Tuna | Coelacanth | Tuna | Clownfish |
| 11 | Tuna | Angelfish | J | Coelacanth | J |
| 12 | Coelacanth | Clownfish | Tuna | J | Tuna |
| 13 | Angelfish | K | K | Clownfish | Coelacanth |
| 14 | K | Tuna | Coelacanth | Q | Q |
| 15 | Coelacanth | Q | Tuna | Angelfish | A |
| 16 | Q | Tuna | Clownfish | Clownfish | Clownfish |
| 17 | Angelfish | Angelfish | J | Tuna | Coelacanth |
| 18 | Coelacanth | J | Coelacanth | J | Tuna |
| 19 | J | Clownfish | J | Coelacanth | Coelacanth |
| 20 | K | Tuna | Coelacanth | Clownfish | J |
| 21 | Clownfish | Coelacanth | K | A | Angelfish |

FIG.13

WINNING COMBINATION TABLE

| WINNING COMBINATION | RANDOM NUMBER |
|---|---|
| × 5 | 0～49 |
| × 5 | 50～51 |
| × 5 | 52～57 |
| × 5 | 58～97 |
| A × 5 | 98～177 |
| K × 5 | 178～277 |
| Q × 5 | 278～477 |
| J × 5 | 478～777 |
| LOSS | 778～5998 |

FIG.14

BASE GAME PAYOUT TABLE

| WINNING COMBINATION | PAYOUT (COINS AWARDED) |
|---|---|
| × 5 | 50枚 |
| × 5 | 40枚 |
| × 5 | 30枚 |
| × 5 | 25枚 |
| A × 5 | 20枚 |
| K × 5 | 15枚 |
| Q × 5 | 10枚 |
| J × 5 | 5枚 |
| LOSS | 0 |

FIG.15
RACE-USE LIGHT EMITTING PORTION ACTIVATION TABLE
| JP WINNING COMBINATION | RACE-USE LIGHT EMITTING PORTION ACTIVATION COUNT | | | |
|---|---|---|---|---|
| | CURVE | | | STRAIGHT PART |
| | Gr.1 | Gr.2 | Gr.3 | ALL GROUPS |
| 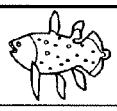 × 5 | 5 | 5 | 4 | 3 |
| 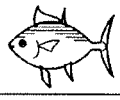 × 5 | 5 | 4 | 4 | 2 |
| 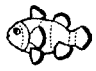 × 5 | 4 | 4 | 3 | 2 |
| 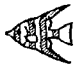 × 5 | 4 | 3 | 3 | 1 |
| A × 5 | 3 | 3 | 2 | 1 |
| K × 5 | 3 | 2 | 2 | 1 |
| Q × 5 | 2 | 2 | 1 | 0 |
| J × 5 | 2 | 1 | 1 | 0 |
| LOSS | 0 | 0 | 0 | 0 |

FIG. 16

PROGRESSIVE VALUE TABLE

| TERMINAL ID | GROUP NAME | EMISSION COLOR SETTING | INDIVIDUAL PROGRESSIVE VALUE |
|---|---|---|---|
| A | Gr. 1 | BLUE | 25 |
| B | Gr. 2 | RED | 30 |
| C | Gr. 2 | BROWN | 10 |
| D | Gr. 1 | AMBER | 50 |
| E | Gr. 3 | GREEN | 20 |
| F | Gr. 3 | GRAY | 5 |
| G | Gr. 1 | YELLOW | 45 |
| H | Gr. 2 | BLACK | 0 |
| I | Gr. 2 | PURPLE | 15 |
| J | Gr. 1 | RED | 30 |
| TOTAL PROGRESSIVE VALUE | | | 230 |

FIG. 17

THE LIGHT EMITTING PORTION EMISSION PATTERN TABLE

| TERMINAL ID | RACE-USE LIGHT EMITTING PORTION BLINKING POSITION | EFFECT-USE LIGHT EMITTING PORTION BLINKING POSITION | | | | |
|---|---|---|---|---|---|---|
| | | 5 | 4 | 3 | 2 | 1 |
| A、B C、D | CURVE | POSITION ① | POSITION ① | POSITION ① | POSITION ① | POSITION ① |
| | STRAIGHT PART | — | — | POSITION ①、②、③ | POSITION ①、②、③ | POSITION ①、②、③ |
| E、F | CURVE | POSITION ② | POSITION ② | POSITION ② | POSITION ② | POSITION ② |
| | STRAIGHT PART | — | — | POSITION ①、②、③ | POSITION ①、②、③ | POSITION ①、②、③ |
| G、H I、J | CURVE | POSITION ③ | POSITION ③ | POSITION ③ | POSITION ③ | POSITION ③ |
| | STRAIGHT PART | — | — | POSITION ①、②、③ | POSITION ①、②、③ | POSITION ①、②、③ |
| ILLUMINANCE [LUX] | | 2,000 | 1,800 | 1,600 | 1,400 | 1,200 |

RUNNING BASE GAME

L
16(101)
2nd CREDIT
401
402
WINNING!! 20 COINS TO BE AWARDED
BAR
BAR
BAR

FIG.24

BASE GAME PAYOUT TABLE

| BET AMOUNT | WINNING COMBINATION | PAYOUT AMOUNT |
|---|---|---|
| 1 | BAR BAR BAR<br>BAR BAR BAR<br>BAR BAR BAR | 60 |
| 1 | BAR BAR BAR<br>BAR BAR BAR | 40 |
| 1 | BAR BAR BAR | 20 |
| 1 | ANY BAR ANY BAR ANY BAR | 10 |
| 1 | BLANK BLANK BLANK | 1 |
| 2 | BAR BAR BAR<br>BAR BAR BAR<br>BAR BAR BAR | 120 |
| 2 | BAR BAR BAR<br>BAR BAR BAR | 80 |
| 2 | BAR BAR BAR | 40 |
| 2 | ANY BAR ANY BAR ANY BAR | 20 |
| 2 | BLANK BLANK BLANK | 2 |
| 3 | 7 7 7 | 1800 |
| 3 | 7 7 7 | 100 |
| 3 | ANY ANY ANY | 100 |

FIG.26

JP GAME PAYOUT TABLE

| JP WINNING COMBINATION | PAYOUT POINT |
|---|---|
| 7 7 7 | 7000 |
| 7 | 300 |
| 7 | 150 |
| BAR BAR BAR | 30 |
| BAR BAR | 20 |
| BAR | 10 |

GAMING MACHINE HAVING A PLURALITY OF TERMINALS AND PLAYING METHOD THEREOF

CROSS REFERENCE TO RELATED APPLICATION

The present application claims priority from U.S. Provisional Patent Application No. 61/058,817, which was filed on Jun. 4, 2008, the disclosure of which is herein incorporated by reference in its entirety.

BACKGROUND OF THE INVENTION

1. Field of the Invention

The present invention relates to a gaming machine and a playing method thereof.

2. Description of Related Art

Among existing gaming machines, there is a gaming machine including: two or more gaming terminals; terminal controllers respectively provided to the gaming terminal, each of which controllers causes associated one of the gaming terminals to run a game; a center controller for controlling all the terminal controllers. Such gaming machines are disclosed in, for example, specifications of U.S. patent application Ser. No. 2002/0042296, U.S. Pat. Nos. 6,733,390, 6,312,332, 6,142,872, 6,361,441, 5,820,459, 4,283,709, and 6,003,013. A terminal controller of a gaming terminal runs a game and awards a payout based on the result of the game independently of another terminal controller of another gaming terminal. The center controller provides a bonus game, in which two or more players compete against one another for various jackpots, such as progressive jackpots or mystery jackpots, through the gaming terminals.

An object of the present invention is to provide a gaming machine providing an entertainment characteristic which is not brought about by the above mentioned known art, and a playing method thereof.

SUMMARY OF THE INVENTION

A gaming apparatus of the present invention includes:

a plurality of gaming terminals respectively having first light emitting portions and game value input ports, which run a base game configured to award a payout according to a predetermined winning and a special game configured to award a special payout which is higher than a payout awarded by the base game, the first light emitting portions each providing an effect to a game, and the game value input ports each receiving an input of a game value used as a resource of a payout for the special game;

a shared display which displays the special payout;

a plurality of routes formed by arranging a plurality of second light emitting portions from the gaming terminals to the shared display;

a game value storage unit which stores a game value input through a game value input port of any of the gaming terminals;

a controller which performs the steps of:

(a1) obtaining game values input through the game value input ports of the gaming terminals, respectively;

(a2) summing up all the game values given by the gaming terminals;

(a3) storing the total of the game values, in the game value storage unit;

(a4) causing the gaming terminals to execute the special game instead of the base game, when the total game value stored in the game value storage unit exceeds a predetermined value;

(a5) every time a gaming terminal achieves a predetermined winning in the special game, (i) blinking a predetermined number of second light emitting portions forming a rout associated with that gaming terminal sequentially from the one closest to that gaming terminal, the predetermined number being determined based on the winning having been achieved, and (ii) blinking the first light emitting portions of that gaming terminal in sync with the second light emitting portions; and (a6) after causing the blinking second light emitting portions to light, awarding a special payout through a gaming terminal whose associated one of routs has all its second light emitting portions lit up to the shared display.

According to the above structure, all the game values input through the game value input ports of the gaming terminals are summed up, and the resulting total is stored in the game value storage unit. When the total game value stored in the game value storage unit exceeds a predetermined value, the special game is run instead of the base game. Every time a predetermined winning is achieved in the special game being run, a predetermined number of second light emitting portions according to the predetermined winning, which portions form a route associated with that gaming terminal, are activated to blink, sequentially from the one closest to that gaming terminal. Further, at the same time, the first light emitting portions of that gaming terminal having achieved the predetermined winning is also activated to blink in sync with the second light emitting portions. When second light emitting portions forming a rout associated with a gaming terminal are turned active all the way to the shared display, a special payout is awarded to the player of that gaming terminal. Activating the second light emitting portions based on a result of the special game provides a new entertainment characteristic that could make players of gaming terminals feel as if they are competing against one another. Further, every time the strip of the activated second light emitting portions approaches the shared display, the first light emitting portions of the gaming terminal blink in sync with the second light emitting portions. This may allow the player to easily grasp the activation status of the associated second light emitting portions.

The present invention may be adapted so that: the first light emitting portions of a gaming terminal and the second light emitting portions forming a rout associated with the gaming terminal blink in the same emission color; and the emission color is made different for each of the gaming terminals.

According to the structure, the emission color of the first light emitting portions and that of the second light emitting portions are the same for one gaming terminal, but are made different from those of another gaming terminal. This may allow each player to easily grasp the activation status of the associated second light emitting portions.

The present invention may be adapted so that, when the second light emitting portions are activated to blink, the controller adjusts the brightness of the second light emitting portions according to the number of the second light emitting portions to blink.

According to the above structure, the brightness is adjusted according to the number of the second light emitting portions to blink. Accordingly, for example, it is possible that, the larger the number of the second light emitting portions blinking, the brighter the second light emitting portions blink. This may able players to easily grasp the number of the associated second light emitting portions blinking.

The present invention may be adapted so that: the first light emitting portions of a gaming terminal and the second light emitting portions forming a rout associated with the gaming terminal blink in the same emission color; the emission color is made different for each of the gaming terminals; and, when the second light emitting portions are activated to blink, the controller adjusts the brightness of the second light emitting portions according to the number of the second light emitting portions to blink.

According to the structure, the emission color of the first light emitting portions and that of the second light emitting portions are the same for one gaming terminal, but are made different from those of another gaming terminal. This may allow each player to easily grasp the activation status of the associated second light emitting portions. Further, the brightness is adjusted according to the number of the second light emitting portions to blink. Accordingly, for example, it is possible that, the larger the number of the second light emitting portions blinking, the brighter the second light emitting portions blink. This may able players to easily grasp the number of the associated second light emitting portions blinking.

A playing method of the present invention for a gaming apparatus including: a plurality of gaming terminals which run a base game configured to award a payout according to a predetermined winning and a special game configured to award a special payout which is higher than a payout awarded by the base game, the game value input ports each receiving an input of a game value used as a resource of a payout for the special game; and a shared display which displays the special payout, the method comprising the steps of:

(b1) obtaining game values input through the game value input ports of the gaming terminals, respectively;

(b2) summing up all the game values given by the gaming terminals;

(b3) storing the total of the game values, in a game value storage unit which stores game values input through the game value input ports of the gaming terminals;

(b4) causing the gaming terminals to execute the special game instead of the base game, when the total game value stored in the game value storage unit exceeds a predetermined value;

(b5) every time a gaming terminal achieves a predetermined winning in the special game, causing (i) the second light emitting portions forming one of routes associated with the gaming terminal to blink sequentially from the one closest to the gaming terminal according to the predetermined winning, the routs each being formed by arranging the second light emitting portions from the associated one of gaming terminals to the shared display, and (ii) first light emitting portions of the gaming terminal, which portions provide an effect to a game, to blink in sync with the second light emitting portions; and (b6) after causing the blinking second light emitting portions to light, awarding a special payout through a gaming terminal whose associated one of routs has all its second light emitting portions lit up to the shared display.

According to the above structure, all the game values input through the game value input ports of the gaming terminals are summed up, and the resulting total is stored in the game value storage unit. When the total game value stored in the game value storage unit exceeds a predetermined value, the special game is run instead of the base game. Every time a predetermined winning is achieved in the special game being run, a predetermined number of second light emitting portions, according to the predetermined winning, which portions form a route associated with that gaming terminal, are activated to blink, sequentially from the one closest to that gaming terminal. Further, at the same time, the first light emitting portions of that gaming terminal having achieved the predetermined winning are also activated to blink in sync with the second light emitting portions. When second light emitting portions forming a rout associated with a gaming terminal are turned active all the way to the shared display, a special payout is awarded to the player of that gaming terminal. Activating the second light emitting portions based on a result of the special game provides a new entertainment characteristic that could make players of gaming terminals feel as if they are competing against one another. Further, every time the strip of the activated second light emitting portions approaches the shared display, the first light emitting portions of the gaming terminal blink in sync with the second light emitting portions. This allows the player to easily grasp the activation status of the associated second light emitting portions.

BRIEF DESCRIPTION OF THE DRAWINGS

FIG. 8 is an explanatory diagram illustrating a symbol column of symbols to be rearranged on a terminal display.

FIG. 13 illustrates a winning combination table.

FIG. 14 illustrates a base game payout table.

FIG. 15 illustrates a table indicating the number of race-use light emitting portions to be activated during the JP game.

FIG. 16 illustrates a progressive value table.

FIG. 17 illustrates an emission pattern table of the light emitting portions.

FIG. 24 is a diagram showing a base game payout table in a gaming machine according to the other embodiment of the present invention.

FIG. 26 is an explanatory diagram showing the JP game payout table in a gaming machine according to the other embodiment of the present invention.

DESCRIPTION OF THE PREFERRED EMBODIMENTS

The following describes an embodiment of a gaming machine and a playing method thereof according to the present invention.

Figure 1:
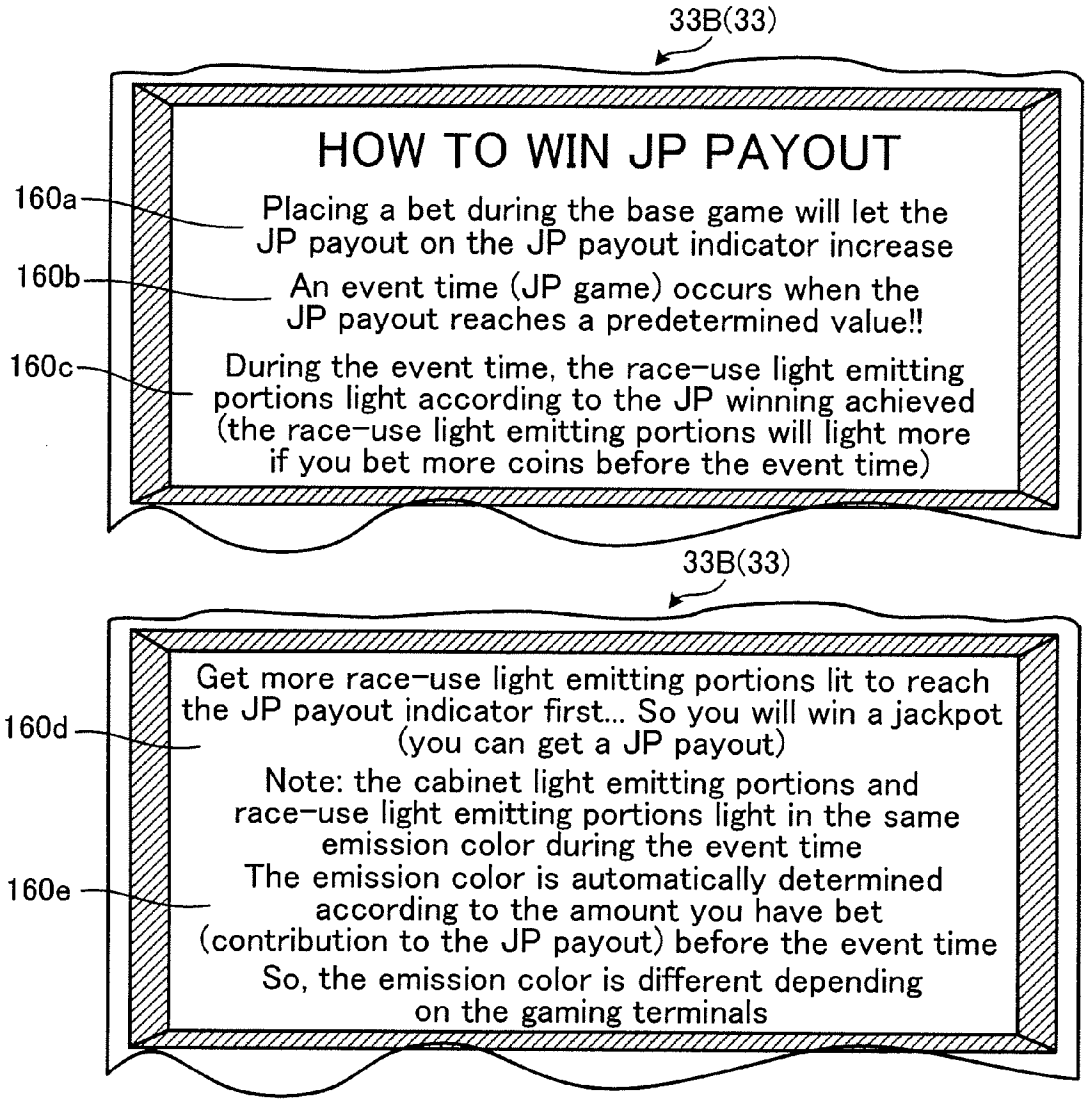
FIG. 1 illustrates an exemplary image displayed on an upper image display panel of a gaming terminal constituting a gaming machine of an embodiment according to the present invention.
Figure 2:
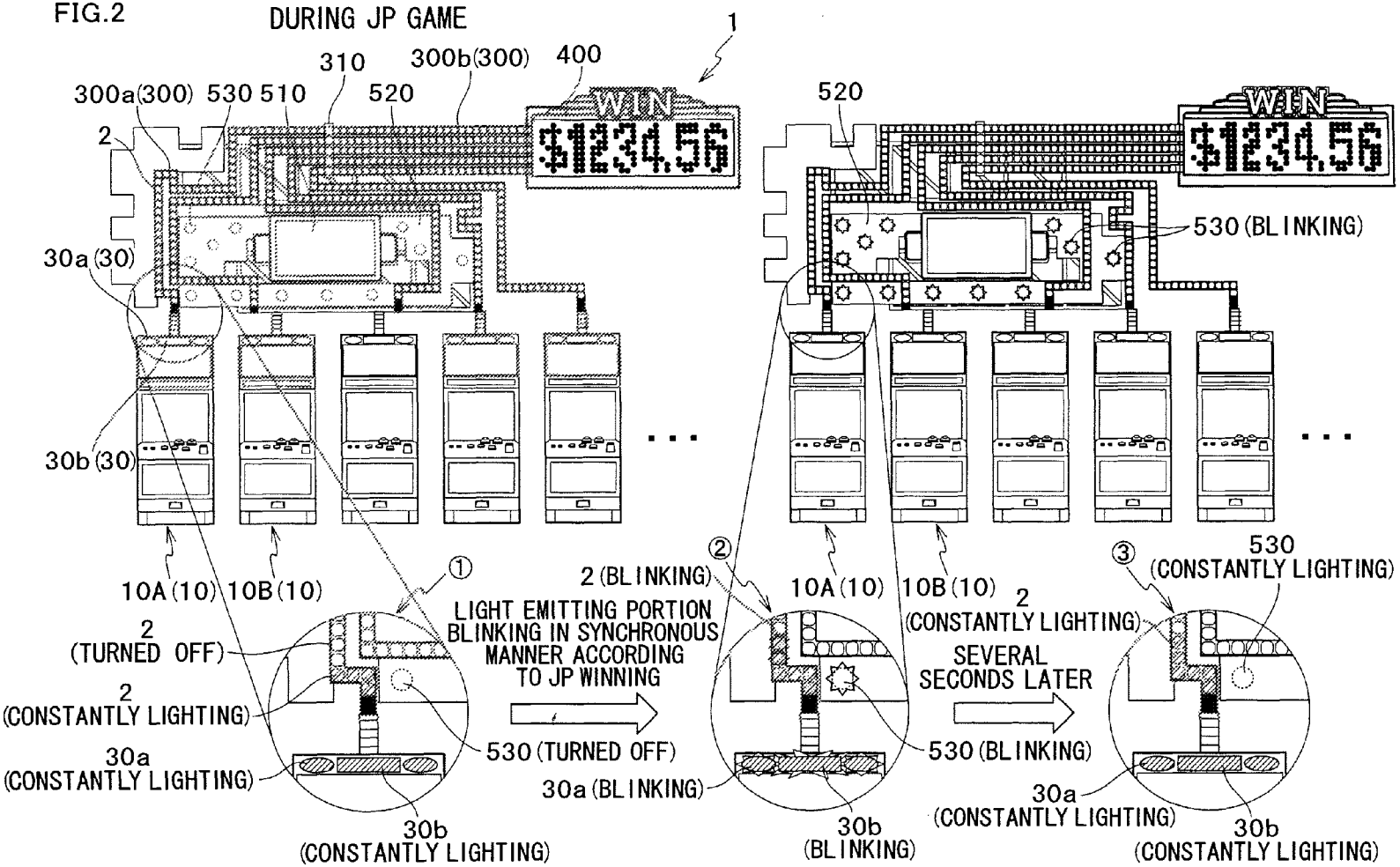
FIG. 2 is an explanatory diagram illustrating the gaming machine and a playing method thereof, according to the embodiment of the present invention.
Figure 3:
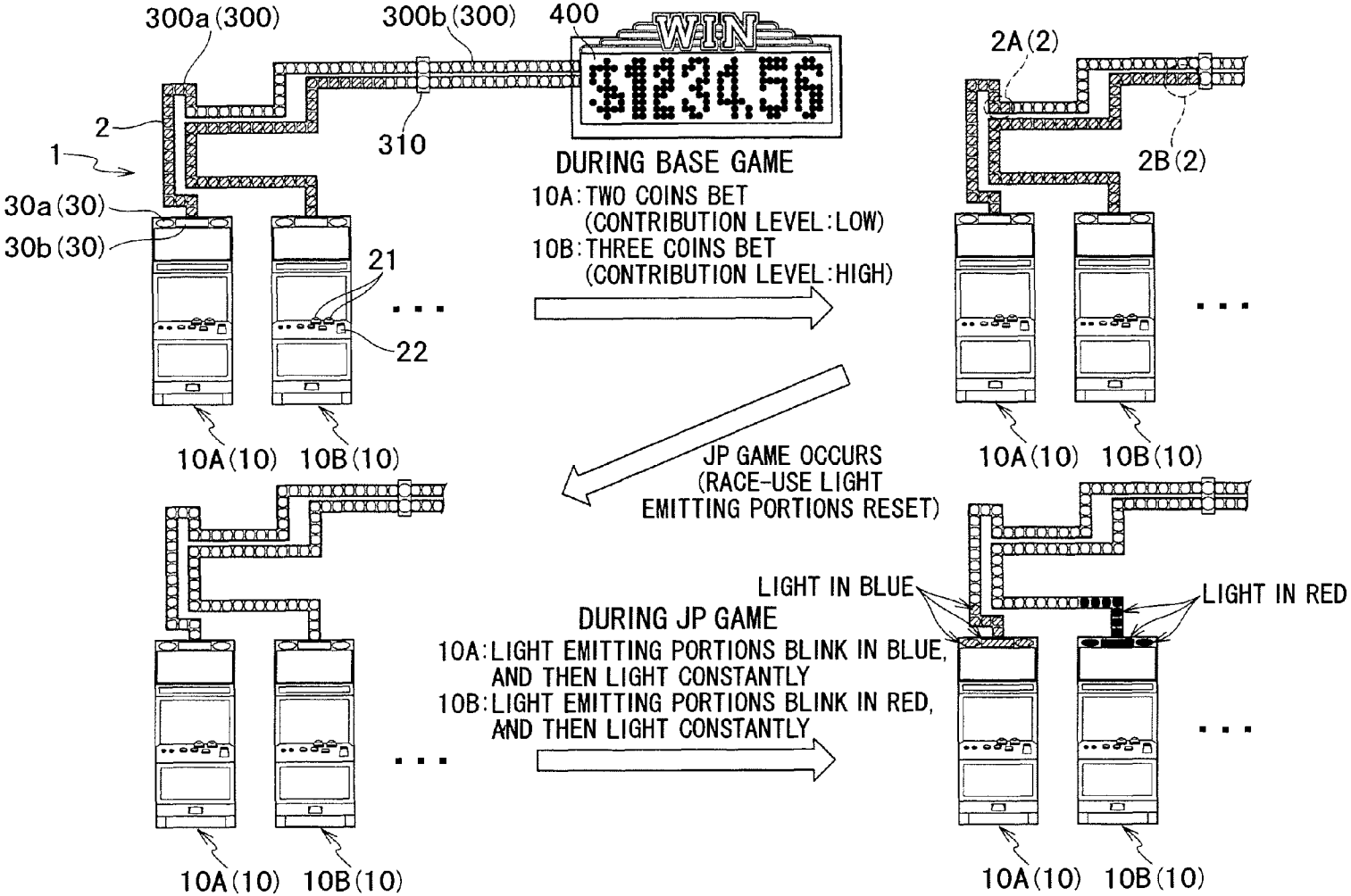
FIG. 3 illustrates a transition from a base game to a JP game.

First, the following provides an overview of the present embodiment, with reference to FIG. 1 to FIG. 3.

A gaming machine 1 of the present invention includes: a plurality of gaming terminals 10, a RAM 43, a plurality of race line units 300, and a JP payout indicator 400. Each of the gaming terminals 10 has: cabinet light emitting portions 30 (first light emitting portions) which provide an effect to a game; and a coin insertion unit 21 or a bill insertion unit 22. The RAM 43 stores a later-mentioned progressive value table which stores a progressive value input through the coin insertion unit 21 or the bill insertion unit 22 of any gaming terminal 10. Each of the race line unit 300 is formed by arranging race-use light emitting portions 2 (second light emitting portions) from associated one of the gaming terminals 10 to the JP payout indicator 400. The gaming machine 1 having the above structure executes a playing method including the steps of: obtaining a progressive value input through the coin insertion unit 21 or the bill insertion unit 22 of any gaming terminal 10; summing up progressive values obtained from all the gaming terminals 10; storing the total progressive value in the progressive value table; causing the gaming terminals 10 to run a JP game instead of a base game, when the total progressive value stored in the progressive value table exceeds a predetermined value; every time a gaming terminal 10 achieves a JP winning in the JP game, (i) blinking a predetermined number of race-use light emitting portions 2 forming a race line unit 300 associated with that gaming terminal 10 sequentially from the one closest to that gaming terminal 10, the predetermined number being determined based on the winning having been achieved, and (ii) blinking the cabinet light emitting portions 30 of that gaming terminal 10 in sync with the race-use light emitting portions 2; and, after lighting the blinking race-use light emitting portions 2, awarding a JP payout through a gaming terminal whose associated race line unit 300 has all its race-use light emitting portions 2 lit up to the JP payout indicator 400.

The present embodiment deals with a case where a slog game is run in each of the gaming terminals 10. Further, the "base game" refers to a game which is run during an ordinary state. In the base game, symbols 180 are rearranged in later-mentioned symbol arrangement areas 150. When the symbols 180 arranged have a relation that meets a winning, a payout is awarded.

The "JP game" is a special free game which is run by the later-detailed JP controller 200, commonly among all the gaming terminals 10 in communication with the JP controller 200. In the present embodiment, the JP game is such that symbols 180 are rearranged in symbol arrangement areas 150 as is done in the base game, and that a JP winning is resulted according to the relation among the symbols 180 arranged. Note that, every time a JP winning is resulted, on or more race-use light emitting portions 2 in a race line unit 300 associated with the gaming terminal 10 having achieved the winning turn active. Then, a JP payout is awarded through a gaming terminal 10, when the race-use light emitting portions 2 forming the associated one of the race line unit 300 turn active along the line unit 300 all the way to the JP payout indicator 400. Note further that an "event time" appearing in this specification refers to a time during which the JP game is running. This event time occurs and the JP game is run, when the later-detailed progressive value, which is the total of progressive values collected from more than one gaming terminals 10, exceeds a predetermined value.

The "JP payout" is a payout based on the total progressive value collected from the gaming terminals 10. A situation where this JP payout is awarded is referred to as "Jackpot".

The "winning" is achieved when a specific symbol combination is formed in the base game. When the winning is achieved, a payout is awarded. In the present embodiment, the winning is achieved when a predetermined number (e.g. 5) of specific symbols 180 are arranged in a matrix 156.

The "JP winning" is achieved when a specific symbol combination is formed in the JP game. When the JP winning is achieved, a predetermined number of the race-use light emitting portions 2 according to the winning achieved turn active. In the present embodiment, the JP winning is achieved when a predetermined number (e.g. 5) of specific symbols 180 are arranged in the matrix 156, as is the case with the base game.

The "progressive value" is a game value based on game medium such as a coin or bill input through the coin insertion unit 21 or bill insertion unit 22 of the gaming terminal 10. This progressive value is collected by the JP controller 200 from each of the gaming terminals 10, and is used as a resource for a JP payout in the JP game.

As illustrated in FIG. 2, the gaming machine 1 of the present embodiment is connected to and in communication with more than one gaming terminals 10 (10A, 10B, . . . ). Further, race line unit 300 are formed from the gaming terminals 10 by arranging the race-use light emitting portions 2, respectively. One end of each race line unit 300 leads to associated one of the gaming terminals 10, and the other end thereof leads to the JP payout indicator 400. Further, the race line unit 300 includes: a curve 300*a* and a straight part 300*b*. At the boundary between the curve 300*a* and the straight part 300*b* is provided a relaying part 310. In short, the curve 300*a* extends from the gaming terminal 10 to the relaying part 310, and the straight part 300*b* extends from the relaying part 310 to the JP payout indicator 400. As is obvious from the above, each of the gaming terminals 10 is communicated with the JP payout indicator 400 via the race line unit 300 associated therewith.

The race-use light emitting portions 2 are LEDs (light-emitting diodes) in the present embodiment, and are capable of lighting in different colors. During the base game, the race-use light emitting portions 2 turn active when a player input a game medium into the gaming terminal 10 through the coin insertion unit 21 or the bill insertion unit 22 thereof, and when a bet of the game medium is made. The number of the race-use light emitting portions 2 to be activated is determined, according to the amount (bet amount) of the game medium placed as a bet. As is already mentioned, a progressive value based on the game medium input during the base game is used as a resource for a JP payout in the JP game. As such, a larger the bet amount results in a higher contribution to the collection of the recourse for the JP payout. That is, the higher the contribution during the base game to the collection of the progressive value for use as the resource for the JP payout (such a contribution is hereinafter simply referred to as contribution level during the base game), the more race-use light emitting portions 2 will be activated. The emission color of the race-use light emitting portions 2 is set to "white" for every gaming terminal 10. It should be noted that the emission color of the race-use light emitting portions 2 during the base game is not limited to white. The emission color however is preferably different from the emission color of the race-use light emitting portions 2 during the JP game.

On the other hand, during the JP game, the race-use light emitting portions 2 blink for several seconds (e.g. three seconds) upon meeting a JP winning, and turn active thereafter. At this time, the later-mentioned cabinet light emitting portions 30 also blink in sync with the race-use light emitting portions 2. The number of the race-use light emitting portions 2 activated during the time is determined based on the JP winning achieved. Further, the emission color of the race-use light emitting portions 2 is different for each of the gaming terminals 10, and is determined based on the contribution level during the base game. Further, the emission color of the cabinet light emitting portions 30 which blink in sync with the race-use light emitting portions 2 is set the same as the emission color of the race-use light emitting portions 2. Note that the race-use light emitting portions 2 are all reset (turned off) when the event time occurs thus causing a transition from the base game to the JP game.

The JP payout indicator 400 displays the amount of JP payout to be awarded upon achieving a Jackpot in the JP game. In the gaming machine 1 of the present embodiment, progressive values respectively based on the game media having been bet in the gaming terminals 10 are accumulatively added, and the resulting total is displayed as a JP payout. The example illustrated in FIG. 2 shows that the JP payout is $1234.56. In this embodiment, the JP payout indicator 400 is structured to include LEDs serving as light emitters. However, the JP payout indicator 400 may be structured as a single liquid crystal display. The light emitters are not limited to LEDs (light-emitting diodes) so long as light is emitted.

Further, as illustrated in FIG. 2, each gaming terminal 10 is provided with the cabinet light emitting portions 30 having a circular light emitting portion 30*a* and a strip light emitting portion 30*b*. These cabinet light emitting portions 30 effectively provide effects to the base game or the JP game, by lighting or blinking. The cabinet light emitting portions 30 are realized by LEDs (light-emitting diodes), and are capable of emitting light in different colors, as is the case of the race-use light emitting portions 2. The cabinet light emitting portions 30 light or blink during the base game so as to provide an effect to the base game. The effect to the base game is effectively achieved by varying the emission color of the cabinet light emitting portions 30. On the other hand, the cabinet light emitting portions 30 during the JP game blink in sync with the race-use light emitting portions 2 in the same emission color, as is already mentioned.

Further, as is illustrated in FIG. 2, the gaming machine 1 has the shared display 510, race cabinets 520, and effect-use light emitting portions 530. The shared display 510 displays a video to provide an effect to the JP game, and the race cabinets 520 support the gaming machine 1. Further, the race cabinets 520 include a plurality of effect-use light emitting portions 530 which provide an effect to the JP game. As is the case with the cabinet light emitting portions 30, the effect-use light emitting portions 530 provides an effect to the JP game when a JP winning is achieved, by blinking in sync with the race-use light emitting portions 2 in the same emission color as the race-use light emitting portions 2. In short, when a JP winning is achieved in the JP game, there will be three members to blink; i.e., the race-use light emitting portions 2 associated with the gaming terminal 10 having achieved the JP winning, the cabinet light emitting portions 30, and the effect-use light emitting portions 530. Afterwards, the race-use light emitting portions 2, the cabinet light emitting portions 30, and the effect-use light emitting portions 530 are controlled so that the lighting modes of these members switches from blinking to constant lighting.

The following describes, with reference to FIG. 1, a method of determining a jackpot-winning gaming terminal 10 through which a JP payout is awarded. FIG. 1 illustrates an exemplary image displayed on an upper image display panel 33B(33) provided to the gaming terminal 10. The upper image display panel 33B displays thereon text strings 160*a* to 160*e* indicating instructions to win the JP payout.

The text string 160*a* indicates that, when a bet is made in a gaming terminal 10 during the base game, a progressive value based on the game medium having been bet is accumulated and displayed on the JP payout indicator 400 as the JP payout.

The text string 160*b* indicates that an event time occurs and the JP game starts, when the JP payout accumulatively displayed on the JP payout indicator 400 reaches a predetermined value.

The text string 160*c* indicates that, during the event time (JP game), a predetermined number of the race-use light emitting portions 2 associated with a gaming terminal 10 having achieved the JP winning turn active, according to the JP winning combination resulted in the gaming terminal 10. The string further indicates that when the race-use light emitting portions 2 are to turn active, the race-use light emitting portions 2 blink in sync with the cabinet light emitting portions 30 of the associated gaming terminal 10, so as to report that the race-use light emitting portion is to turn active.

The text string 160*d* indicates that the JP payout is awarded to a gaming terminal 10 whose race-use light emitting portions 2 in the associated race line unit 300 are all activated.

The text string 160*e* indicates an instruction about the emission color of the cabinet light emitting portions 30 and that of the race-use light emitting portions 2 of the gaming terminal 10 during the event time. Specifically, the string indicates that the emission color of the cabinet light emitting portions 30 and that of the race-use light emitting portions 2 of one gaming terminal 10 are the same during the event time. The string further indicates that the emission color of the cabinet light emitting portions 30 and that of the race-use light emitting portions 2 is determined according to the contribution level during the base game before the occurrence of the event time, and that the color is made different for each of the gaming terminals 10.

In the example illustrated in FIG. 2, a gaming terminal 10 with the terminal ID "A" has three of the associated race-use light emitting portions 2 lit based on the already-achieved JP winning. The rest of the race-use light emitting portions 2 are not lit (See in the circled ①. Note that the cabinet light emitting portions 30 and the effect-use light emitting portions 530 are all active at this point. In this case, if another JP winning is achieved in the next JP game, two of the race-use light emitting portions 2 blink for several seconds based on the JP winning. Further, the cabinet light emitting portions 30 and the effect-use light emitting portions 530 also blink for several seconds in sync with the blinking of the race-use light emitting portions 2 (See in the circle ②. Note that these three members all blink in the same emission color. Then, the lighting modes of these three members switches from blinking to constant lighting, after several seconds of blinking (See in the circle ③).

Next described with reference to FIG. 3 is how a transition from the base game to the JP game occurs. In the example illustrated in FIG. 2, two coins are bet in the gaming terminal 10A and three coins are bet in the gaming terminal 10B, during the base game. In this case, two more race-use light emitting portions 2A associated with the gaming terminal 10A turn active, and three more race-use light emitting portions 2B associated with the gaming terminal 10B turn active (see upper right of the figure). As is obvious from the above example, the larger the amount bet in the base game, the more associated race-use light emitting portions 2 will be activated.

Further, when the event time occurs thus causing a transition from the base game to the JP game, the race-use light emitting portions 2 are all reset (turned off) once (see bottom left of the figure). During the JP game, the cabinet light emitting portions 30 and the race-use light emitting portions 2 of the gaming terminal 10A blink in blue every time the JP winning is achieved, and are constantly lit thereafter. On the other hand, the cabinet light emitting portions 30 and the race-use light emitting portions 2 of the gaming terminal 10B blink in red, and are constantly lit thereafter (See lower right of the figure). In this manner, the emission color of the cabinet light emitting portions 30 and that of the race-use light emitting portions 2 are different depending on the contribution level during the base game.

Figure 4:
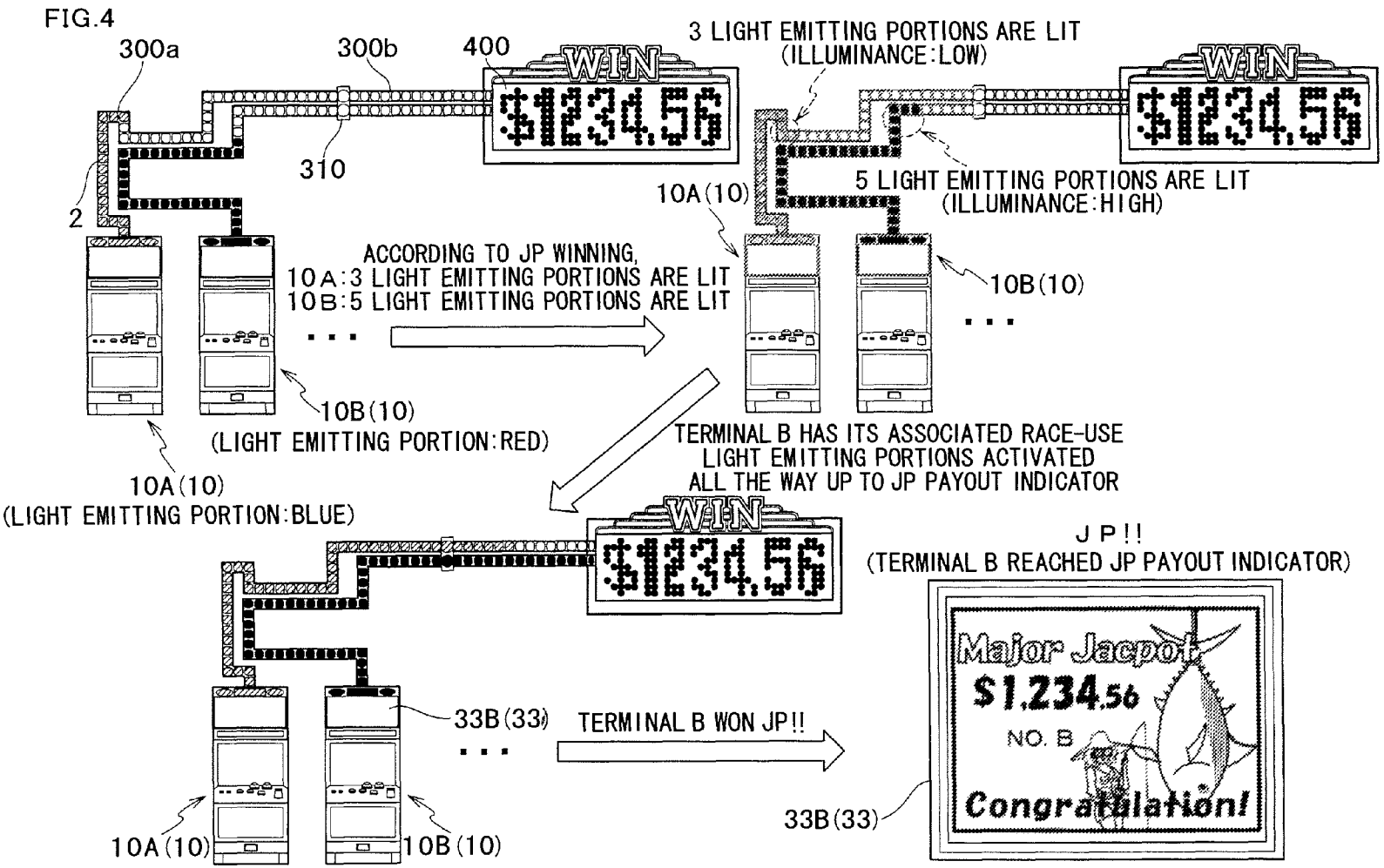
FIG. 4 is an explanatory diagram illustrating how race-use light emitting portions turn active during a JP game.

FIG. 4 illustrates how the race-use light emitting portions 2 turn active during the JP game. As is already mentioned, every time a JP winning is achieved during the JP game, a predetermined number of race-use light emitting portions 2 according to the JP winning achieved are turned active to blink, and are constantly lit thereafter. Repeating this will increase the number of the race-use light emitting portions 2 being lit. When the race-use light emitting portions 2 are lit all the way up to the JP payout indicator 400 along the race line unit 300, the jackpot is achieved. Further, a control is performed so that the illuminance of the race-use light emitting portions 2 becomes higher with an increase in the number of the race-use light emitting portions 2 activated to blink and constantly light.

In the example illustrated in FIG. 4, the gaming terminal 10A has three of its associated race-use light emitting portions 2 activated to blink and constantly light, according to a JP winning the gaming terminal 10A has achieved. On the other hand, the gaming terminal 10B has five of its associated race-use light emitting portions 2 activated to blink and constantly light, according to a JP winning the gaming terminal 10B has achieved. In this case, the illuminance of the race-use light emitting portions 2 associated with the gaming terminal 10B is higher than that of the race-use light emitting portions 2 associated with the gaming terminal 10A (see upper right of the figure).

Further, in the example illustrated in FIG. 4, the gaming terminal 10B has all the associated race-use light emitting portions 2 activated up to the JP payout indicator 400 than the gaming terminal 10A (see lower left of the figure). Thus, the gaming terminal 10B is likely to achieve the jackpot, and win the JP payout. Note that, when the gaming terminal 10B wins a jackpot, the upper image display panel 33B of the gaming terminal 10B displays a video indicating that the gaming terminal 10B has won the Jackpot (see lower right of the figure)

Figure 5:
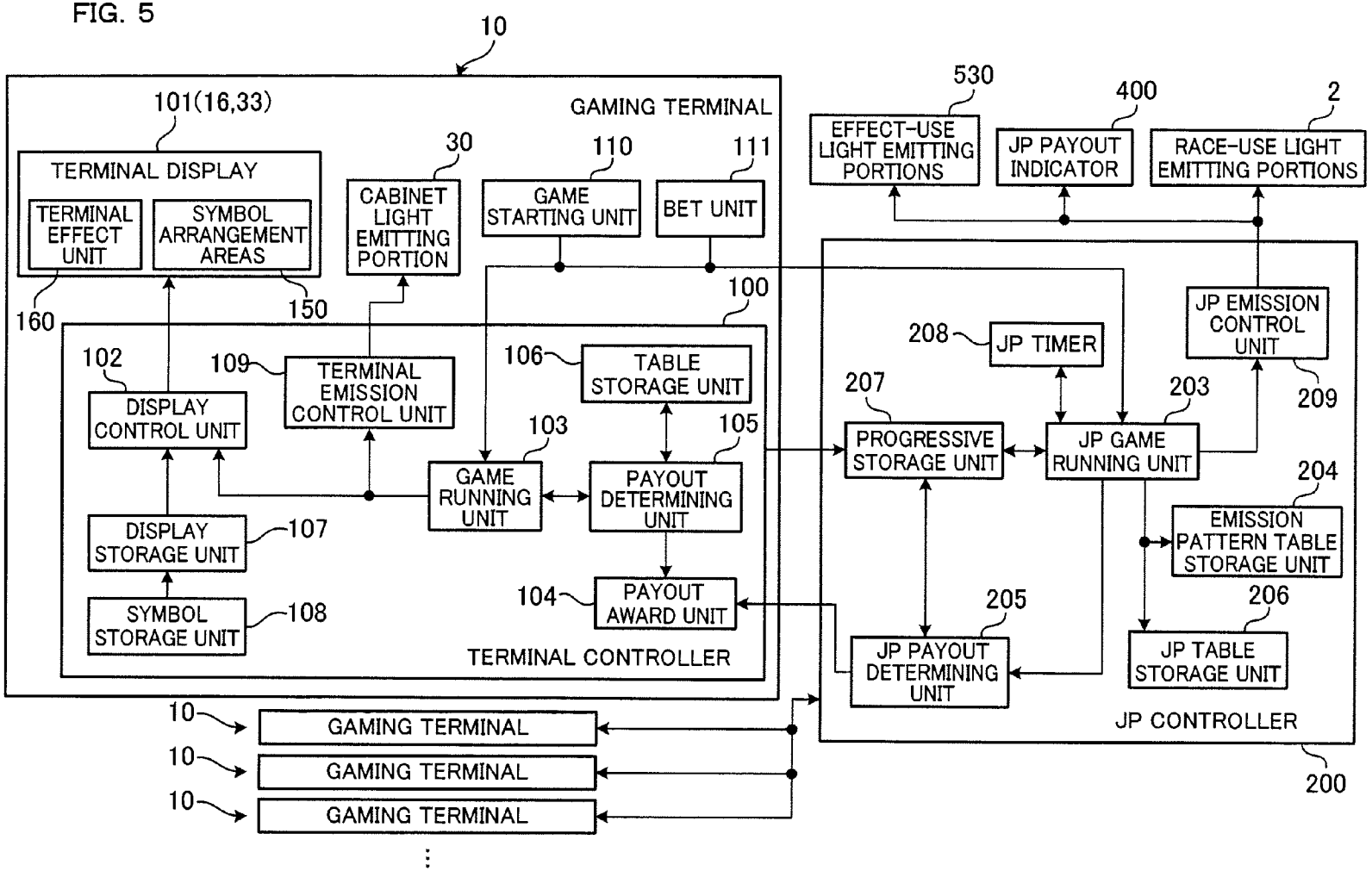
FIG. 5 is a block diagram of the gaming machine.

As illustrated in FIG. 5, the gaming machine 1 which executes the playing method has the JP payout indicator 400, the JP controller 200, the gaming terminals 10, the race-use light emitting portions 2, and the effect-use light emitting portions 530. Each of the gaming terminals 10 includes a terminal display 101, a terminal controller 100, the cabinet light emitting portions 30, and the effect-use light emitting portions 530.

Figure 6:
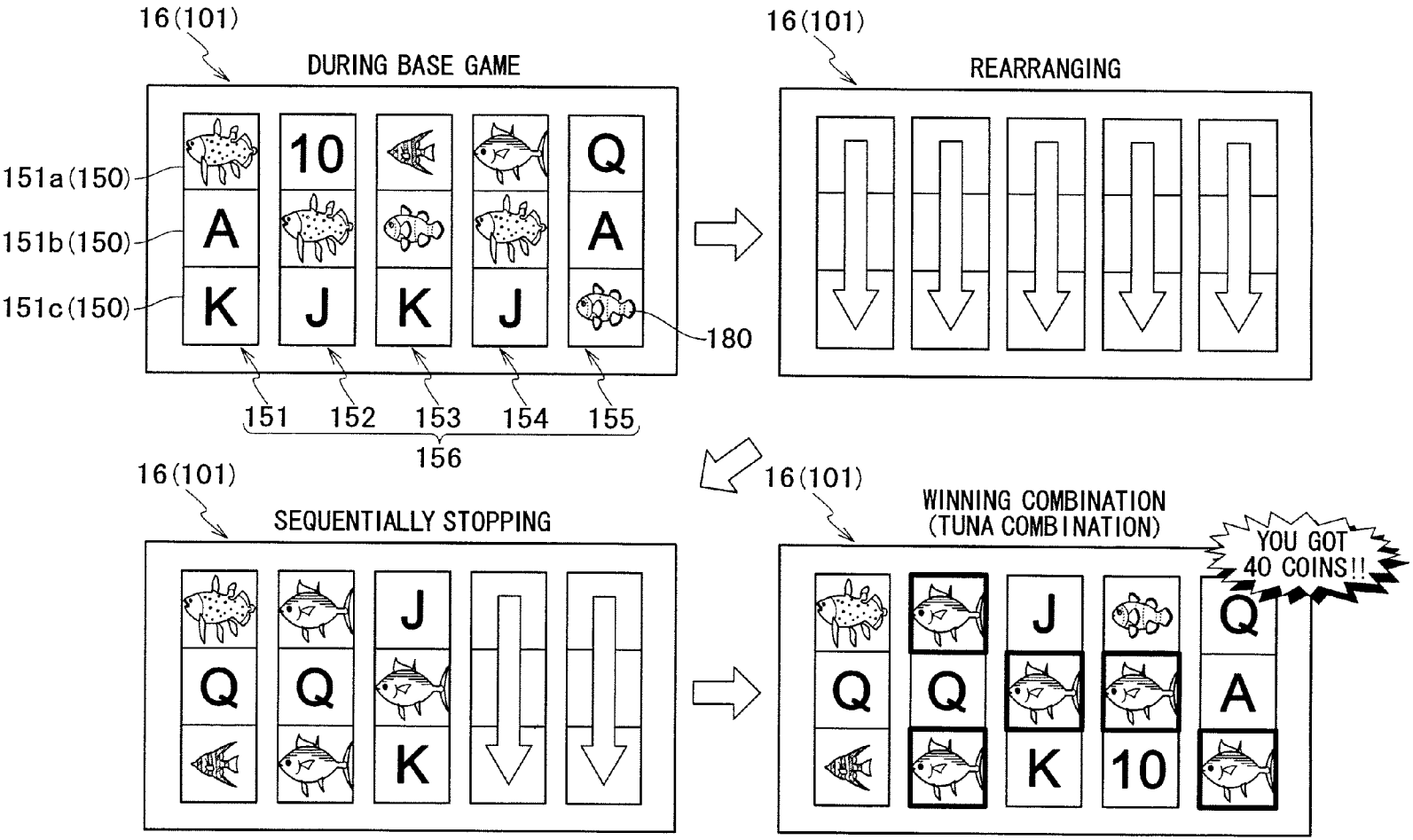
FIG. 6 is an explanatory diagram concerning a base game.

As illustrated in FIG. 6, the terminal display 101 has a plurality of symbol arrangement areas 150, and symbols 180 are arranged in the symbol arrangement areas 150.

The "arranging" in this specification means a state where the symbols 180 can be visually observed by a player. That is, the wording means a state where the symbols 180 are displayed in the symbol arrangement areas 150, in FIG. 6. Arranging the symbols 180 again after dismissing the symbols 180 is referred to as "rearranging".

The terminal display 101 may have a mechanical structure adopting a reel device which rotates a reel to arrange the symbols 180. Alternatively, the terminal display 101 may have an electrical structure in which a video reel is displayed as an image and symbols 180 on a video reel are arranged in the form of an image. Further, the terminal display 101 may adopt a combination of the mechanical structure (reel) and the electrical structure (video reel). Examples of the electrical structure include a liquid crystal display device, a CRT (cathode-ray tube), a plasma display device, or the like. Further, the number of symbol arrangement areas 150 is not limited. A specific structure of the terminal display 101 will be detailed later.

Further, the terminal display 101 has a terminal effect unit 160. The terminal effect unit 160 provides an visual effect to the base game or the JP game. An example of such an effect is an indication of winning the jackpot on the upper image display panel 33B as is the case of FIG. 4. Further, the terminal effect unit 160 displays text strings 160*a* to 160*e* indicating the instructions to win the JP payout as shown in FIG. 1.

The JP payout indicator 400 displays the amount of the JP payout which is the total of progressive values collected from the gaming terminals 10.

Each of the race-use light emitting portions 2 lights upon activation. The race-use light emitting portions 2 are controlled to be activated one after another, from the position of each gaming terminal 10 to the JP payout indicator 400.

The effect-use light emitting portions 530, under the control of the JP emission control unit 209, blink and constantly light to provide an effect to the JP game. Note that the effect-use light emitting portions 530 are each made of an LED (light-emitting diode) and are capable of lighting in various emission colors, as is the case of the cabinet light emitting portions 30 and the race-use light emitting portions 2.

(Terminal Controller 100)

The terminal controller 100 is structured to execute the following processes: a first process of running the base game configured to award a payout according to a predetermined winning, and awarding the payout; a second process of running the JP game based on an instruction from the JP controller 200; a third process of, when the JP game is run, activating the cabinet light emitting portions 30 according to an instruction from the JP controller 200; a fourth process of awarding a JP payout according to an instruction from the JP controller 200. In other words, the terminal controller 100 has first to fourth processing units.

The terminal controller 100 is connected to the JP controller 200 and is in communication with the JP controller 200.

As illustrated in FIG. 5, the terminal controller 100 is connected to a game starting unit 110. The game starting unit 110 has a function of outputting a game start signal, in response to an operation by the player. The game start signal output is then input to a later-described game running unit 103.

Further, the terminal controller 100 is connected to a BET unit 111. The BET unit 111 has functions of receiving a bet entered through an operation by the player, and outputting a BET signal in response to the bet entered. The BET signal output is input to a later-described game running unit 103.

The terminal controller 100 includes a table storage unit 106, a game running unit 103, a symbol storage unit 108, a display storage unit 107, and a display control unit 102.

The table storage unit 106 stores a later-described winning combination table of FIG. 13, a base game payout table of FIG. 14, or the like.

The game running unit 103 runs a base game, triggered by a game start signal from the game starting unit 110. In the base game, symbols 180 are rearranged in the symbol arrangement areas 150 of the terminal display 101. Further, the terminal controller 100 outputs a progressive signal, triggered by the game start signal. The progressive signal is a signal indicating a progressive value.

Further, the game running unit 103 runs, when receiving a JP game start signal from the JP controller 200, the JP game which rearranges symbols 180 in the symbol arrangement areas 150 of the terminal display 101. At this point, the game running unit 103 rearranges the symbols 180 in the symbol arrangement areas 150, based on the winning combination table of FIG. 13 which is stored in the table storage unit 106.

Further, when running the JP game, the game running unit 103 causes a later-described terminal emission control unit 109 to activate the cabinet light emitting portions 30, based on emission color information contained in the JP game start signal. For example, when the emission color information in the JP game start signal indicates "Red", the game running unit 103 causes the terminal emission control unit 109 to activate the cabinet light emitting portions 30 to light in red. Further, the game running unit 103, when receiving a light emitting portion blinking signal from the JP controller, causes the terminal emission control unit 109 to blink the cabinet light emitting portions 30 based on the information of the emission pattern in the light emitting portion blinking signal. Note that the game running unit 103 causes the terminal emission control unit 109 to light or blink the cabinet light emitting portions 30 during the base game, so as to provide an effect to the base game. Here, the "emission pattern" refers to a pattern in which the cabinet light emitting portions 30, the race-use light emitting portions 2, and the effect-use light emitting portions 530 emit light. This "emission pattern" includes information on blinking period, emission color, and information on brightness such as illuminance.

Further, the game running unit 103 outputs a JP winning signal to the JP controller 200, when the payout determining unit 105 determines that a JP winning is achieved. Further, the game running unit 103 ends the JP game, when receiving a JP game end signal from the JP controller 200.

The symbol storage unit 108 stores the symbols 180. The display storage unit 107 stores symbols 180 in the symbol storage unit 108 as symbol to be displayed.

The display control unit 102, under the control of the game running unit 103, reads out symbols in the display storage unit 107, and display the symbols 180 in the symbol arrangement areas 150 of the terminal display 101. A detailed display state will be detailed later. Further, the display control unit 102 outputs video to the terminal effect unit 160 of the terminal display 101, based on the control performed by the game running unit 103.

Further, the terminal controller 100 has the terminal emission control unit 109. The terminal emission control unit 109, under the control of the game running unit 103, causes the cabinet light emitting portions 30 to light or blink.

Further, the terminal controller 100 has a payout determining unit 105 and a payout awarding unit 104. The payout determining unit 105 determines whether to award a payout, based on a relation among the symbols 180 rearranged in the symbol arrangement areas 150 of the terminal display 101. That is, the payout determining unit 105 determines whether a predetermined winning is achieved during the base game, and determines whether a predetermined JP winning is achieved during the JP game. At this time, the payout determining unit 105 determines a payout amount, based on the base game payout table of FIG. 14 which is stored in the table storage unit 106. The payout awarding unit 104, during the base game, awards a payout based on the determination of the payout determining unit 105. Further, the payout awarding unit 104 awards a JP payout, based on the JP payout signal from the JP controller 200.

Meanwhile, each block of the terminal controller 100 may be realized with hardware, or with software as needed.

(Operation of Terminal Controller 100)

The following describes an operation of the terminal controller 100 in the above structure. First, the BET unit 111 accepts a BET entered through an operation by a player. Then, in response to the operation, the game starting unit 110 outputs a game start signal to cause the game running unit 103 to start a base game. When the base game is run, symbols 180 are arranged in the symbol arrangement areas 150 by the display control unit 102, based on the control of the game running unit 103.

The payout determining unit 105 determines whether a predetermined winning has been achieved, based on the relation between the symbols 180 rearranged in the symbol arrangement areas 150. If it is determined that a predetermined winning has been achieved, the payout awarding unit 104 awards a payout. In this manner, the terminal controller 100 in each gaming terminal 10 executes the first process of running a base game, which is configured to award a payout according to a predetermined winning, in the gaming terminal 10, and awarding a payout according to the predetermined winning.

Further, upon receiving the JP game start signal from the JP controller 200, the game running unit 103 starts running the JP game. When the JP game runs, the display control unit 102, under the control of the game running unit 103, arranges and displays symbols 180 in the symbol arrangement areas 150. The payout determining unit 105 determines whether a predetermined JP winning has been achieved, based on the relation between the symbols 180 rearranged in the symbol arrangement areas 150. In this manner, the terminal controller 100 executes the second process of running the JP game based on an instruction from the JP controller 200.

Further, when the JP game is run, the terminal emission control unit 109, under the control of the game running unit 103, activates the cabinet light emitting portions 30. Further, when the game running unit 103 receives a light emitting portion blinking signal from the JP controller 200, the game running unit controls the terminal emission control unit 109 so as to blink the cabinet light emitting portions 30. Note that the emission color at this time is based on the emission color information contained in the JP game start signal from the JP controller 200. In this manner, the terminal controller 100 executes the third process of, when the JP game is run, causing the cabinet light emitting portions 30 to blink or light, based on an instruction from the JP controller 200.

Further, the payout awarding unit 104 awards the JP payout when receiving the JP payout signal from the JP controller 200. In this manner, the terminal controller 100 executes the fourth process of awarding the JP payout according to an instruction from the JP controller 200.

(JP controller 200)

The JP controller 200 executes: a fifth process of obtaining progressive values input through the coin insertion units 21 or the bill insertion units 22 of the gaming terminals 10, respectively; a sixth process of summing up all the progressive values obtained from the gaming terminals 10; a seventh process of storing the total progressive value thus summed up, in the progressive value table illustrated in FIG. 16, which table is stored in the progressive storage unit 207; an eighth process of running the JP game instead of the base game in the gaming terminals 10, when the total progressive value stored in the progressive value table exceeds a predetermined value; a ninth process of, every time a gaming terminal 10 achieves a predetermined JP winning in the JP game, causing (I) race-use light emitting portions 2 according to the JP winning having achieved, which portions 2 forming the associated one of the race line units 300, to turn active to blink sequentially from the one closest to the gaming terminal, and (II) the cabinet light emitting portions 30 of the gaming terminal 10 to blink in sync with the race-use light emitting portions 2; and a tenth process of, after lighting the blinking race-use light emitting portions 2, awarding a JP payout through a gaming terminal whose associated race line unit 300 has all its race-use light emitting portions 2 lit up to the JP payout indicator 400.

Further, when blinking the race-use light emitting portions 2, the JP controller 200 executes an eleventh process of adjusting the brightness of the race-use light emitting portions 2 according to the number of the race-use light emitting portions 2 to blink. In other words, the JP controller 200 includes a fifth to eleventh process units.

As illustrated in FIG. 5, the JP controller 200 is connected to the terminal controller 100 and is in communication with the terminal controller 100.

The JP controller 200 has a progressive storage unit 207, a JP table storage unit 206, an emission pattern table storage unit 204, and a JP timer 208.

The progressive storage unit 207 stores a progressive value indicated by the progressive signal from the terminal controller 100, in the later-described progressive value table shown in FIG. 16. The progressive value table has the "individual progressive value" field for storing a progressive value given by a gaming terminal 10, in association with that gaming terminal 10. The table further includes a "total progressive value" field which stores the total of all the progressive values obtained from the gaming terminals 10.

The JP table storage unit 206 stores the race-use light emitting portion activation table illustrated in FIG. 15. The emission pattern table storage unit 204 stores a later-mentioned light emitting portion emission pattern table of FIG. 17. The JP timer 208 measures a time, based on the later-described JP game running unit 203.

Further, the JP controller 200 has a JP game running unit 203, a JP emission control unit 209, and a JP payout determining unit 205.

The JP game running unit 203 stores a progressive value indicated by a progressive signal given by a terminal controller 100 to the progressive storage unit 207, in association with that gaming terminal 10, in the "individual progressive value" field of the progressive value table shown in FIG. 16 which is stored in the progressive storage unit 207. Further, the JP game running unit 203 sums up all the progressive values from the gaming terminals 10, which values are stored in the "individual progressive value" field, and stores the resulting total progressive value in the "total progressive value" field of the progressive value table. Further, every time a progressive value is stored in an "individual progressive value" field, the JP game running unit 203 causes the later-mentioned JP emission control unit 209 to activate the race-use light emitting portions 2 forming a race line unit 300 of the associated gaming terminal 10 so that a predetermined number of the race-use light emitting portions 2 light sequentially from the one closest to the associated gaming terminal 10, according to the amount of progressive values having been stored.

Further, the JP game running unit 203 outputs a JP game start signal to the terminal controllers 100, when the total progressive value stored in the "total progressive value" field reaches a predetermined value, thereby causing the terminal controllers 100 to run the JP game instead of the base game, in the respective gaming terminals 10. At this time, the JP game running unit 203 determines, for each of the gaming terminals 10, the emission color of the cabinet light emitting portions 30 and that of the race-use light emitting portions 2 and the setting at the time of the JP game, based on the amount of the progressive value of the progressive value stored in the "individual progressive value" field associated with the gaming terminal 10. Information of the emission colors thus determined is included in the JP game start signal. Further, the JP game running unit 203 causes the JP emission control unit 209 to reset (turn off) all the race-use light emitting portions 2, when outputting the JP game start signal.

Further, the JP game running unit 203 causes the JP timer 208 to start measuring time upon outputting the JP game start signal, and then outputs a JP game end signal to the terminal controllers 100 upon elapse of a predetermined time. Note that the JP game running unit 203 causes the JP timer 208 to stop measuring time, when the JP game running unit 203 causes the JP payout determining unit 205 to output a JP payout signal to the terminal controllers 100.

Further, the JP game running unit 203 determines, when receiving a JP winning signal from the terminal controller 100, the number of race-use light emitting portions 2 to turn active based on the JP winning signal. Further, the JP game running unit 203 determines the emission pattern of each light emitting portion, based on the number of race-use light emitting portions 2 to turn active. At this point, the JP game running unit 203 outputs a light emitting portion blinking signal including the emission pattern information, to the terminal controller 100 to which the JP winning signal have been sent. Then, the JP game running unit 203 causes the JP emission control unit 209 to activate the race-use light emitting portions 30 of the race line unit 300 associated with an intended gaming terminal 10, in such a manner that the number of race-use light emitting portions 2 thus determined turn active in the emission color and emission pattern thus determined, sequentially from the one closest to the gaming terminal 10. At the same time, the JP game running unit 203 causes the JP emission control unit 209 to activate the effect-use light emitting portions 530 based on the emission color and the emission pattern thus determined.

Further, the JP game running unit 203 determines whether the race-use light emitting portions 2 in any of the race line units 300 have turned active all the way to the JP payout indicator 400. If the JP game running unit 203 determines that the race-use light emitting portions 2 in any one of the race line units 300 have turned active all the way to the JP payout indicator 400, the JP game running unit 203 causes the JP payout determining unit 205 to output a JP payout signal to the terminal controller 100 of the associated gaming terminal 10.

The JP emission control unit 209 displays the total progressive value stored in the "total progressive value" field in the JP payout indicator 400. Further, the JP emission control unit 209, under the control of the JP game running unit 203, light the race-use light emitting portions 2 in the race line unit 300 of an intended gaming terminal 10 so that the race-use light emitting portions 2 turn active sequentially from the one closest to the gaming terminal 10.

The JP payout determining unit 205, under the control of the JP game running unit 203, outputs a JP payout signal to the terminal controller 100 of an intended gaming terminal 10.

Note that each block of the JP controller 200 may be realized with hardware, or with software as needed.

(Operation of JP Controller 200)

The following describes an operation of the JP controller 200 in the above structure. First, the progressive storage unit 207 receives a progressive signal from the terminal controller 100 of a gaming terminal 10. In this manner, the JP controller 200 executes the fifth process of obtaining progressive values input through the coin insertion units 21 or the bill insertion units 22 of the gaming terminals 10, respectively.

Then, the JP game running unit 203 stores, in the "individual progressive value" field of the progressive value table illustrated in FIG. 16, a progressive value indicated by a progressive signal transmitted from a gaming terminal 10 to the progressive storage unit 207, in association with that gaming terminal 10. Further, the JP game running unit 203 sums up all the progressive values from the gaming terminals 10 which are stored in the "individual progressive value" field. In this manner, the JP controller 200 executes the sixth process of summing up all the progressive values obtained from the gaming terminals 10.

The JP game running unit 203 then sums up the progressive values, and stores the resulting total of the progressive values in the "total progressive value" field of the progressive value table illustrated in FIG. 16. In this manner, the JP controller 200 executes the seventh process of storing the total progressive value thus summed up, in the progressive value table illustrated in FIG. 16, which table is stored in the progressive storage unit 207.

When the total progressive value stored in the "total progressive value" field of the progressive value table exceeds a predetermined value, the JP game running unit 203 outputs a JP game start signal to the terminal controllers 100 to run the JP game instead of the base game in the gaming terminals 10. In this manner, the JP controller 200 executes the eighth process of running the JP game instead of the base game in the gaming terminals 10, when the total progressive value stored in the progressive value table exceeds a predetermined value.

Further, the game running unit 203 determines for each gaming terminal 10, the JP game running unit 203 determines the emission color of the cabinet light emitting portions 30 and that of the race-use light emitting portions 2, based on the amount of the progressive value stored in the "individual progressive value" field. When a JP winning signal is received which is output from a terminal controller 100 of a gaming terminal 10 every time the gaming terminal 10 achieves a predetermined JP winning, the JP game running unit 203 determines the number of race-use light emitting portions 2 to turn active, based on the JP winning signal. Further, the JP game running unit 203 determines the emission pattern of the each light emitting portion based on the number of the race-use light emitting portions 2 to turn active, and a light emitting portion blinking signal is output to the terminal controller 100 to which a JP winning signal has been transmitted. Then, the JP game running unit 203 controls the JP emission control unit 209 so as to activate the determined number of race-use light emitting portions 2 forming the race line unit 300 of an intended gaming terminal 10 so that the race-use light emitting portions 2 blink or light in the emission color thus determined. In this manner, the JP controller 200 executes the ninth process of, every time a gaming terminal 10 achieves a predetermined JP winning in the JP game, causing (I) race-use light emitting portions 2 according to the JP winning having achieved, which portions 2 forming the associated one of the race line units 300, to turn active to blink sequentially from the one closest to the gaming terminal, and (II) the cabinet light emitting portions 30 of the gaming terminal 10 to blink in sync with the race-use light emitting portions 2.

The JP game running unit 203 determines whether race-use light emitting portions 2 of any of the race line units 300 turn active all the way to the JP payout indicator 400. When the JP game running unit 203 determines that race-use light emitting portions 2 of a race line unit 300 turn active all the way to the JP payout indicator 400, a JP payout signal is output from the JP payout determining unit 205 to the terminal controller 100 of the gaming terminal 10 associated with the race line unit 300. In this manner, the JP controller 200 executes the tenth process of awarding a JP payout through a gaming terminal 10, when the race-use light emitting portions 2 forming the associated one of the race line unit 300 turn active along the line unit 300 all the way to the JP payout indicator 400.

Note that the information of the emission pattern in the light emitting portion blinking signal output from the game running unit 103 in the ninth process contains information of a pattern related to the brightness (e.g. illuminance) of the race-use light emitting portions 2 to emit light. In this manner, the JP controller 200 execute the eleventh process of, when blinking the race-use light emitting portions 2, adjusting the brightness of the race-use light emitting portions 2 according to the number of the race-use light emitting portions 2 to blink.

As is obvious from the above operations, the gaming machine 1 executes a playing method including the steps of: obtaining progressive a progressive value input through the coin insertion unit 21 or the bill insertion unit 22 of any gaming terminal 10; summing up progressive values obtained from all the gaming terminals 10; storing the total progressive value in the progressive value table illustrated in FIG. 16 which table is stored in the progressive storage unit 207; causing the gaming terminals 10 to run the JP game instead of the base game, when the total progressive value stored in the progressive value table exceeds a predetermined value; every time a gaming terminal 10 achieves a JP winning in the JP game, (i) blinking a predetermined number of race-use light emitting portions 2 forming a race line unit 300 associated with that gaming terminal 10 sequentially from the one closest to that gaming terminal 10, the predetermined number being determined based on the winning having been achieved, and (ii) blinking the cabinet light emitting portions 30 of that gaming terminal 10 in sync with the race-use light emitting portions 2; and, after lighting the blinking race-use light emitting portions 2, awarding a JP payout through a gaming terminal whose associated race line unit 300 has all its race-use light emitting portions 2 lit up to the JP payout indicator 400.

Further, the gaming machine 1 executes a playing method which includes a step of, when blinking the race-use light emitting portions 2, adjusting the brightness of the race-use light emitting portions 2 according to the number of the race-use light emitting portions 2 to blink.

According to this playing method, progressive values input through the coin insertion units 21 or the bill insertion units 22 of the gaming terminals 10 are all summed up, and the resulting total is stored in the progressive value table of FIG. 16 which is stored in the progressive storage unit 207. When the total progressive value stored in the progressive value table exceeds a predetermined value, the JP game is run instead of the base game. Every time a JP winning is achieved in a gaming terminal during the JP game being run, a predetermined number of the race-use light emitting portions 2 according to the JP winning, which portions in a race line unit 300 associated with the gaming terminal 10, are turned active to blink sequentially from the one closest to that gaming terminal 10. Further, at the same time, the cabinet light emitting portions 30 of that gaming terminal 10 blink in sync with the race-use light emitting portions 2. Then, when race-use light emitting portions 2 of any of the race line units 300 turn active all the way to the JP payout indicator 400 along the race line unit 300, a JP payout is awarded to the associated gaming terminal 10. Activating the race-use light emitting portions 2 based on a result of the JP game provides a new entertainment characteristic that could make players of gaming terminals 10 feel as if they are competing against one another. Further, every time the strip of the activated race-use light emitting portions 2 approaches to the JP payout indicator 400, the cabinet light emitting portions 30 of the corresponding gaming terminal blink in sync with the race-use light emitting portions 2. This may allows a player to easily grasp the activation status of the race-use light emitting portions 2.

According to the above structure, the brightness is adjusted according to the number of the race-use light emitting portions 2 being active. Accordingly, for example, it is possible that, the larger the number of the race-use light emitting portions 2 blinking, the brighter the race-use light emitting portions 2 blink and constantly light. This may able players to easily grasp the number of the associated race-use light emitting portions blinking.

Further, in the above mentioned playing method, the cabinet light emitting portions 30 of a gaming terminal 10 and race-use light emitting portions 2 in a race line unit 300 associated with that gaming terminal 10 both blink in the same emission color, and the emission color is made different for each of the gaming terminals 10. This may allow each player to easily grasp the activation status of the associated race-use light emitting portions 2. (Base Game)

The following specifically describes an example of a base game in the gaming machine 1 and the playing method. Note that the following example deals with a case where the terminal display 101 adopts a video reel and arranges symbols on a video reel, as illustrated in FIG. 6.

As illustrated in FIG. 6, a matrix 156 is in the middle of the terminal display 101. The matrix 156 includes symbols 180, which are scroll displayed. Further, display windows 151 to 155 are each divided into an upper stage 151*a*, a central stage 151*b*, and a lower stage 151*c*. The symbols 180 are stopped (arranged) in the stages 151*a* to 155*c*, respectively. The matrix 156 is a symbol matrix including five columns/three rows. The matrix 156 however is not limited to the one with the five-columns/three-rows.

As illustrated in FIG. 6, the terminal display 101 variably displays symbols 180 when a base game is started in the gaming terminal 10. When this variable-displaying of symbols 180 stops, symbols 180 are rearranged in the symbol arrangement areas 150. Then, when a winning is achieved according to a relation among the rearranged symbols 180, a payout according to this winning is awarded.

In the example illustrated in FIG. 6, a winning with a combination "Tuna" is achieved, and forty coins are awarded to the player as such (see lower right of the figure).

(JP Game)

The following specifically describes an example of a JP game in the gaming machine 1 and the playing method.

The JP game is run when the accumulated total of progressive values exceeds a predetermined amount. In the JP game, the symbols 180 are rearranged in the matrix 156 in each gaming terminal 10, as is the case of the base game. When a predetermined JP winning is achieved by the rearrangement of the symbols 180, one or more race-use light emitting portions 2 turn active in random numbers, in the race line unit 300 associated to the gaming terminal 10 in which the winning has occurred.

Here, each race line unit 300 includes a curve 300*a* and a straight part 300*b*. The number of the race-use light emitting portions 2 to turn active is controlled so that, even the same JP winning occurs, the numbers of race-use light emitting portions 2 to turn active differs between the curve 300*a* and the straight part 300*b*. While the race-use light emitting portions 2 in the curve 300*a* are to turn active, the number of the race-use light emitting portions 2 to turn active is determined depending on which one of the later-mentioned groups the associated gaming terminal 10 belongs to, whereas, while the race-use light emitting portions 2 in the straight part 300*b* are to turn active, the number of the race-use light emitting portions 2 to turn active is determined irrespective of which group the associated gaming terminal belongs to.

As is already mentioned, the activation of the race-use light emitting portions 2 in the curve 300*a* is controlled so that the numbers of the race-use light emitting portions 2 to turn active differ between the gaming terminals 10 in which the same JP winning has occurred, depending on which one of the groups shown in the progressive value table of FIG. 16 each gaming terminal 10 belongs to. This is because each curve 300*a* is formed so as to avoid the later-mentioned shared display 510, race cabinets 520, or a game signboard 540. More specifically, the gaming terminals 10 in the present embodiment are grouped into the following three groups: a group (Gr. 3) of gaming terminals 10 whose respective curved ling parts 300*a* are short; a group (Gr. 1) of gaming terminals 10 whose respective curves 300*a* are long; and a group (Gr. 2) of other gaming terminals 10. Even if the same JP winning occurs in more than one of these gaming terminals 10. The number of the race-use light emitting portions 2 to turn active is set to be small for the gaming terminal 10 of Gr. 3 whose curve 300*a* is short, whereas the number is set to be large for the gaming terminal 10 of Gr. 1 whose curve 300*a* is long.

Figure 7:
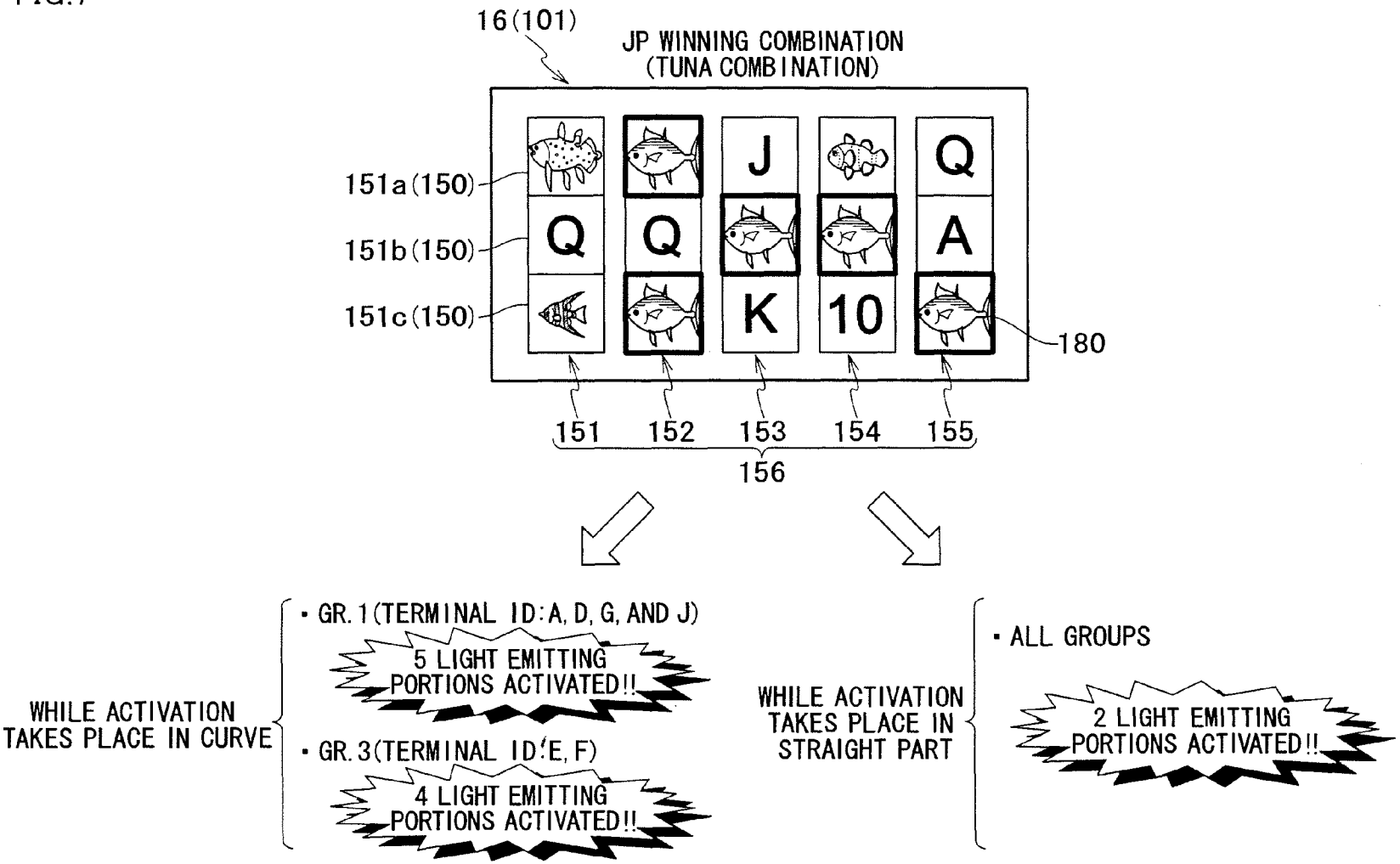
FIG. 7 is an explanatory diagram concerning the JP game.

In the example illustrated in FIG. 7 in which the same JP winning based on the combination of "Tuna" has occurred in more than one gaming terminals 10, five race-use light emitting portions 2 are turned active for the gaming terminal 10 of Gr. 1, whereas four race-use light emitting portions 2 are turned active for the gaming terminal 10 of Gr. 3 (see lower left of the figure). To be fair to the players of all the gaming terminals 10, the number of times the same JP winning has to be achieved to have the race-use light emitting portions 2 in the curve 300*a* turned active up to the relaying part 310 is uniformly set for each gaming terminal 10.

On the other hand, when the same JP winning based on the combination of "Tuna" occurs in more than one gaming terminals 10 while the activation of the race-use light emitting portions 2 takes place in the straight part 300*b*, each gaming terminal 10 has two of the associated race-use light emitting portions 2 turn active (see lower right of figure).

[Symbol, Combination, or the Like]

The terminal display 101 has the matrix 156 including symbol columns each having twenty two symbols 180 as illustrated in FIG. 8. To each of the symbols constituting the symbol columns is given one of code numbers 0 to 21. Each symbol column is made from a combination of "Coelacanth", "Tuna", "Clownfish", "Angelfish", "A", "K", "Q", and "J".

Of the symbols in the symbol columns, the display windows 151 to 155 each displays (arranges) three successive symbols. The symbols arranged in the upper stages 151*a* to 155*a*, the central stages 151*b* to 155*b*, and the lower stages 151*c* to 155*c* form a symbol matrix having five-columns/three-rows. When a BET button and a start button are sequentially pressed in this order to start a game, symbols constituting the symbol matrix start to scroll. This scrolling of the symbols stops (rearrangement) after a predetermined period from the beginning of the scrolling.

Further, for each symbol, a predetermined scatter symbol is determined in advance. Scatter symbols are such symbols that a player is put in an advantageous position when a predetermined number or more of them are displayed in the matrix 156. For example, the advantages includes: a state where coins corresponding to the scatter symbols are paid out, a state where the number of coins to be paid out is added to a credit, a state where a bonus game is started.

Here, a bonus game is a game which is run separately from the JP game and which is more advantageous to the player than the base game. No particular limitation is put on the bonus game, as long as it is a gaming state advantageous to the player, that is, it is more advantageous than the base game. For example, the bonus game may include a state where more game media are obtainable than in the base game, a state where a game medium is obtainable with higher probability than in the base game, a state where a game medium is less consumed than in the base game, and the like. Specifically, a free game, a second game, a feature game, and the like may be mentioned as examples of the bonus game.

[Mechanical Structure of Gaming Machine 1]

Next, the following describes a specific example of mechanical and electrical structures of the gaming machine 1 thus structured.

A gaming machine 1 is placed in a game arcade such as a casino. This gaming machine 1 runs a unit game which involves a game medium. The game medium is a coin, bill, or a value in the form of electronic information. However, the game medium in the present invention is not particularly limited. For example, a medal, token, electronic money, ticket or the like are also possible. Further, the ticket is not particularly limited and may be a later-described ticket with a barcode or the like ticket.

Figure 9:
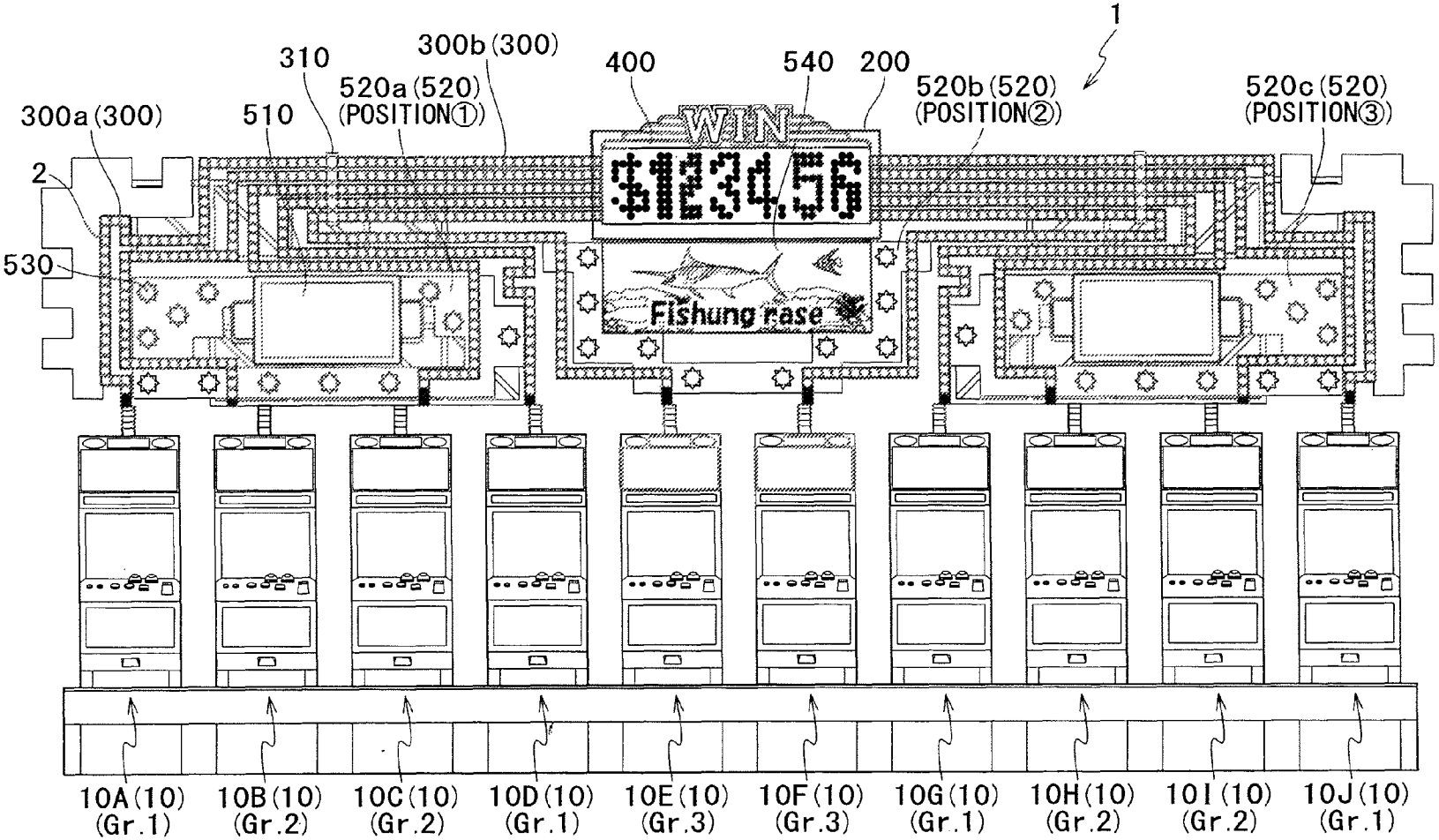
FIG. 9 is a front view showing an external appearance of the gaming machine.

As illustrated in FIG. 9, the gaming machine 1 includes: the gaming terminals 10 each of which runs a base game independently of another gaming terminal 10; the JP controller 200 which is connected and is in communication with the gaming terminals 10, and which runs a JP game; the JP payout indicator 400 which displays the amount of the JP payout to be awarded in the JP game; and the race line units 300 formed by arranging the race-use light emitting portions 2, which respectively extends from the gaming terminals 10 to the JP payout indicator 400. Each of the race line units 300 includes the curve 300*a* and the straight part 300*b*. At the boundary between the curve 300*a* and the straight part 300*b* is provided a relaying part 310. Further, the gaming terminals 10 are grouped by the size of the associated curves 300*a*. The gaming terminals 10 associated with long curves 300*a* are in Gr. 1 and are respectively terminals "A", "D", "G" and "J" The gaming terminals 10 associated with short curves 300*a* are in Gr. 1 and are respectively terminals "E" and "F". The other gaming terminals 10 are in Gr. 2 and are respectively terminals "B", "C", "H", and "I".

Further, the gaming machine 1 includes the shared display 510, the race cabinets 520 and a game signboard 540. The shared display 510 displays a video which provides an effect to the JP game. The race cabinets 520 are each cabinet to support the gaming machine 1. The race cabinets 520 are: race cabinets 520*a* to 520*c*. The race cabinet 520*a* is called "position ①", and is disposed above the gaming terminals 10A to 10D. The race cabinet 520*b* is called "position ②", and is disposed above the gaming terminals 10E and 10F. The race cabinet 520*c* is called "position ③", and is disposed above the gaming terminals 10G to 10J. Further, the each race cabinet 520 has effect-use light emitting portions 530 which provides an effect to the JP game by blinking and constantly lighting. The game signboard 540 is a signboard indicating the title of the game run in the gaming machine 1. As is already mentioned, each curve 300*a* is formed so as to avoid these members. Note that the present embodiment deals with a case where the respective lengths of the curves 300*a* are different from one another depending on the gaming terminals 10; however, the curves 300*a* may all have the same lengths. In such a case, grouping of the gaming terminals 10 is not necessary. In either case, to activate the race-use light emitting portions 2 of the curve 300*a* up to the relaying part 310, the number of times one type of JP winning has to be achieved are the same in each of the curves 300*b*.

(Mechanical Structure of Gaming Terminal 10)

Figure 10:
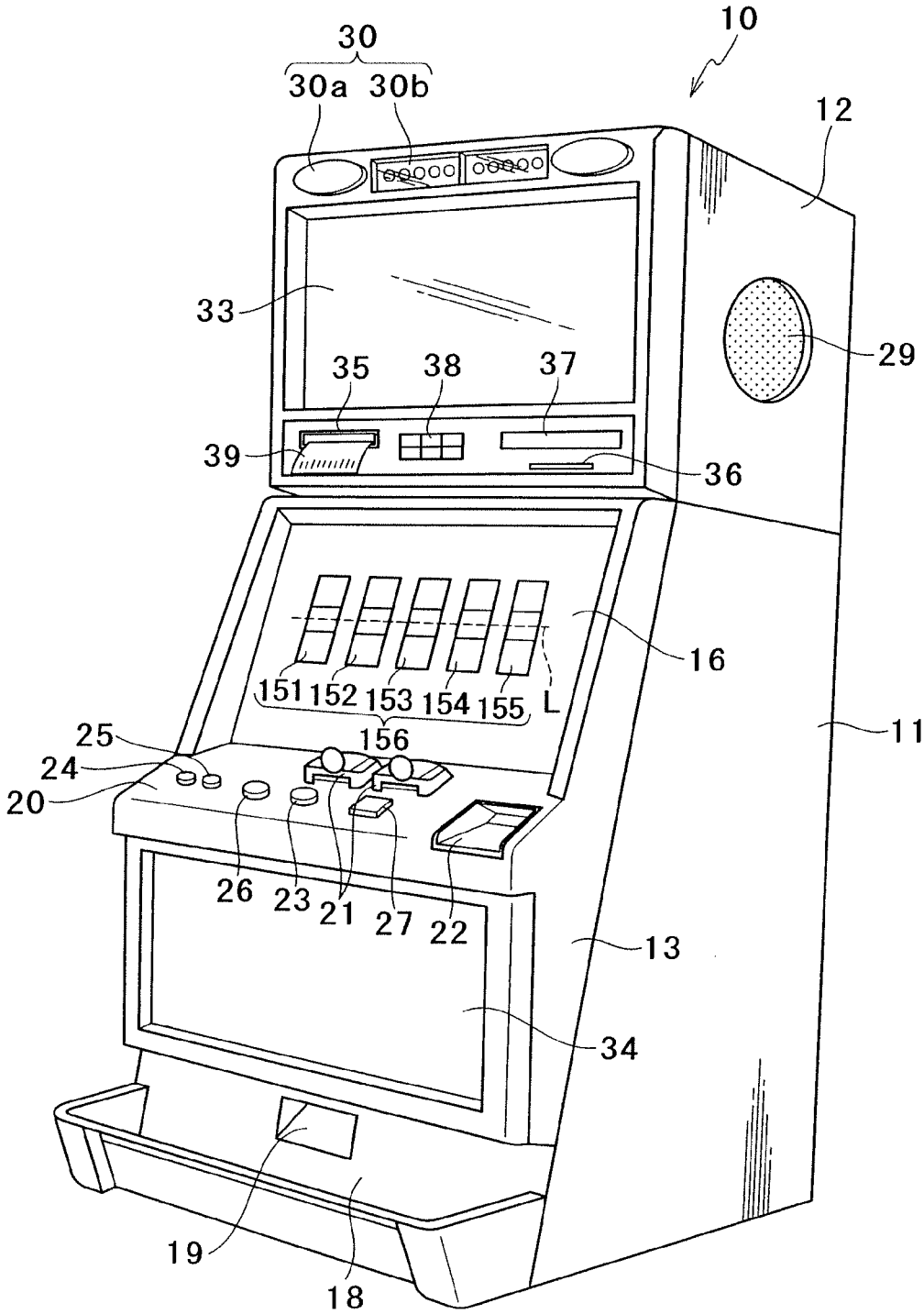
FIG. 10 is a perspective view illustrating an external appearance of the gaming terminal.

As illustrated in FIG. 10, the gaming terminal 10 includes: a cabinet 11, a top box 12 provided above the cabinet 11, and a main door 13 provided on the front surface of the cabinet 11. The main door 13 has a lower image display panel 16. The lower image display panel 16 has a transparent liquid crystal panel for displaying various information. The lower image display panel 16 displays display windows 151 to 155 (matrix 156) for arranging therein symbols 180. Further, the lower image display panel 16 displays as needed various information and effect images related to a game.

The present embodiment deals with a case where the lower image display panel 16 electrically displays symbols 180 arranged in five-columns/three-rows. However, the present invention is not limited to this.

The lower image display panel 16 displays a single activated payline L. Note that the number of paylines L may be two or more. When the number of paylines L is two or more, the number of paylines L activated may be determined according to a predetermined condition, such as the number of coins placed as a BET.

Note that the lower image display panel 16 may have a credit value indicator and a payout value indicator. The credit value indicator displays a total value (hereinafter also referred to as total credit value) which a gaming terminal 10 can pay out to a player. When symbols stopped along a payline L form a winning combination, the payout value indicator displays the number of coins to be paid out.

Further, scatter symbols may be adopted, and the number of coins to be paid out may be determined, according to the number of scatter symbols displayed on the matrix 156. Note that the payline L does not necessarily have to be displayed.

Below the lower image display panel 16 provided are a control panel 20, a coin insertion slot 21, and a bill validator 22. The control panel 20 is provided with various buttons 23 to 27. These buttons 23 to 27 allow a player to input instructions related to a game played by the player. Through the coin insertion slot 21, a coin is received in the cabinet 11.

The control panel 20 includes: a spin button 23, a change button 24, a cashout button 25, a 1-BET button 26, and a maximum BET button 27. The spin button 23 is for inputting an instruction to start symbol scrolling. The change button 24 is used to ask a staff person in the game arcade for exchange of money. The cashout button 25 is for inputting an instruction to pay out coins corresponding to the total credit value to the coin tray 18 via the coin outlet 19.

The 1-BET button 26 is used for betting one coin out of those corresponding to the total credit value. The maximum BET button 27 is used for betting, out of those corresponding to the total credit value, a maximum number of coins (e.g., fifty coins) which can be bet in one game.

The bill validator 22 validates whether bill is genuine or not and receives the genuine bill into the cabinet 11. Note that the bill validator 22 is capable of reading a barcode attached to a later-mentioned ticket 39 having a barcode (hereinafter simply referred to as ticket 39). When the bill validator 22 reads the ticket 39, it outputs to the main CPU 41 a read signal representing information having read from the barcode.

On the lower front surface of the main door 13, that is, below the control panel 20, a belly glass 34 is provided. On the belly glass 34, a character of a gaming terminal 10 or the like is drawn. On the front surface of top box 12 is provided an upper image display panel 33. The upper image display panel 33 has a liquid crystal panel and displays an effect image, introduction to the game, rules of the game, or the like.

Further, the top box 12 has a speaker 29 for performing an audio output. Below the upper image display panel 33 are provided a ticket printer 35, a card reader 36, a data displayer 37, and a keypad 38. The ticket printer 35 prints, onto a ticket, a barcode having encoded data containing credit value, date and time, identification number of a gaming terminal 10 or the like, thereby issuing a ticket 39 having a barcode attached thereto. A player can play a game in another gaming terminal 10 with the ticket 39 having the barcode, or exchange the ticket 39 having the barcode with bill or the like at a change booth or the like of the game arcade.

The card reader 36 reads/writes data from/into a smart card. The smart card is carried by a player, and stores therein data for identifying the player, data relating to a history of games played by the player, or the like.

The data displayer 37 includes a fluorescent display or the like, and displays the data read by the card reader 36 and the data input by the player through the keypad 38. The keypad 38 is for entering instructions or data relating to issuing of a ticket or the like.

Further, above the upper image display panel 33 are provided two cabinet light emitting portions 30 each including a circular light emitting portion 30*a* and the strip light emitting portion 30*b*. The cabinet light emitting portions 30 are realized by LEDs (light-emitting diodes), and are capable of emitting light in different colors.

[Electrical Structure of Gaming Machine 1]

Figure 11:
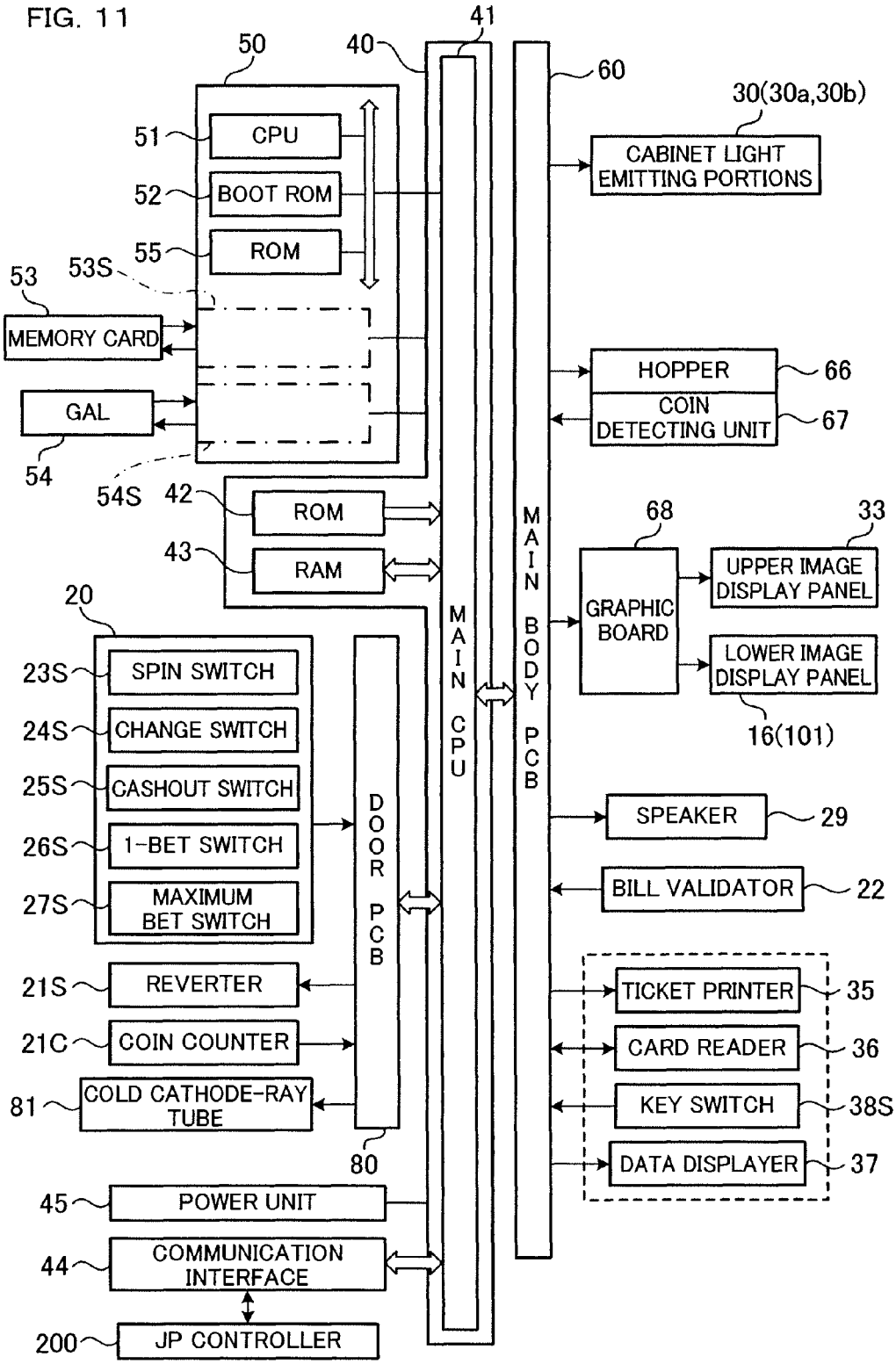
FIG. 11 is a block diagram illustrating an electrical structure of the gaming terminal.
Figure 12:
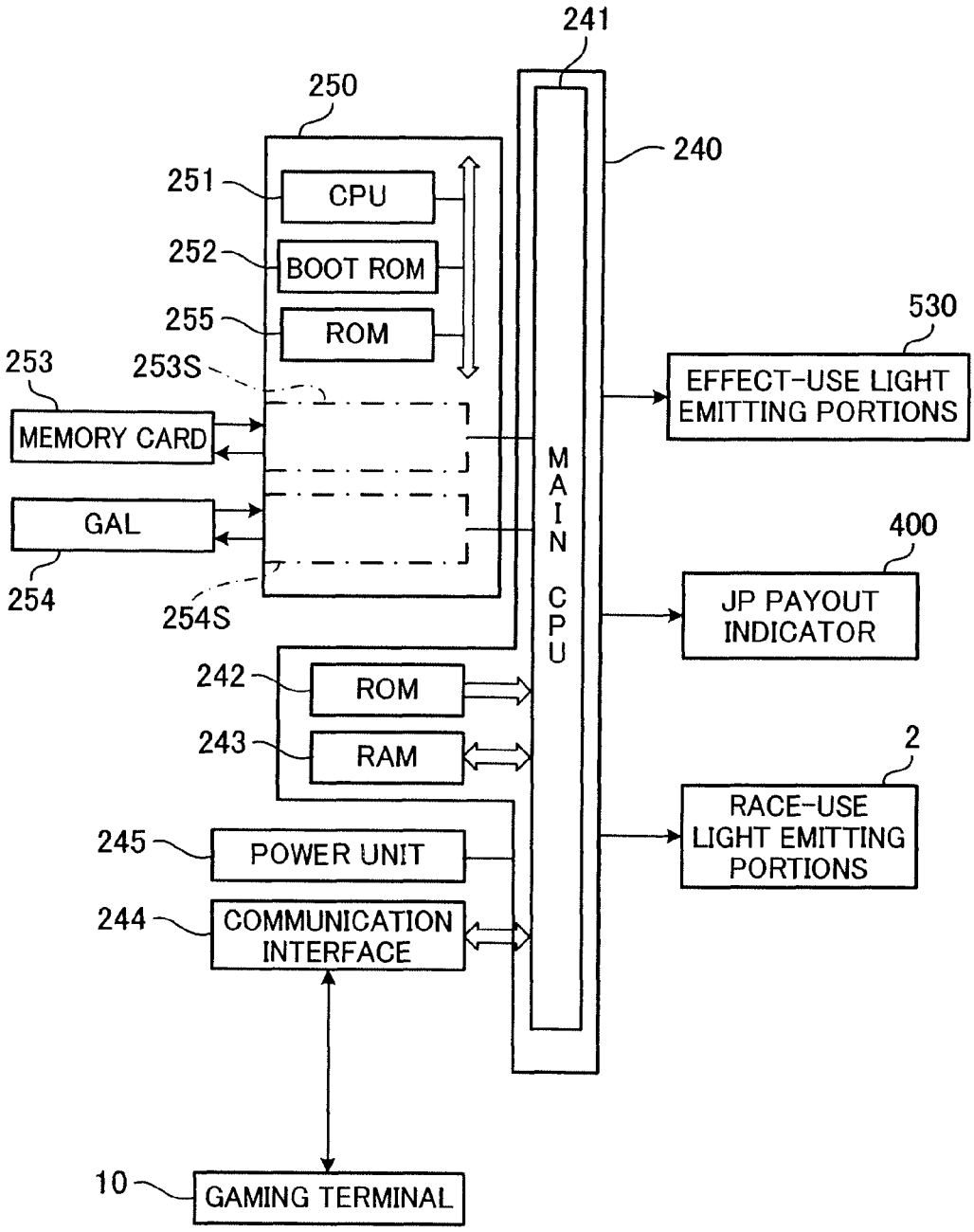
FIG. 12 is a block diagram illustrating an electrical structure of a JP controller.

FIGS. 11 and 12 are block diagrams each illustrating an electrical structure of the entire gaming machine 1.

(Electrical Structure of Gaming Terminal 10)

FIG. 11 is a block diagram showing an electrical structure of the gaming terminal 10. As illustrated in FIG. 11, the cabinet 11 includes a control unit having a terminal controller 100. As illustrated in FIG. 11, the control unit includes a motherboard 40, a main body PCB (Printed Circuit Board) 60, a gaming board 50, a door PCB 80, various switches, sensors, or the like.

The gaming board 50 is provided with a CPU (Central Processing Unit) 51, a ROM 55, a boot ROM 52, a card slot 53S corresponding to a memory card 53, and an IC socket 54S corresponding to a GAL (Generic Array Logic) 54. The CPU 51, the ROM 55, and the boot ROM 52 are connected to one another through an internal bus.

The memory card 53 stores therein a game program and a game system program. The game program contains a stop symbol determining program. The stop symbol determining program determines symbols (code number corresponding to the symbol) to be stopped in the symbol arrangement areas 150. This stop symbol determining program contains sets of symbol weighting data respectively corresponding to various payout rates (e.g., 80% 84%, 88%). Each set of the symbol weightingdata indicates, for each of the display windows 151 to 155, a code number of each symbol and at least one random number allotted to the code number. The numerical value is a value within a predetermined range of 0 to 256 for example.

The payout rate is determined based on payout rate setting data output from the GAL 54. Based on a set of the symbol weighting data corresponding to the payout rate determined, a symbol to be stopped is determined.

The memory card 53 stores therein various types of data for use in the game programs and the game system programs. For example, the memory card 53 stores a table listing combinations of a symbol 180 to be displayed on the display windows 151 to 155 of FIG. 6 and an associated range of random numerical values. This data is transferred to the PAM 43 of the motherboard 40, at the time of running a game programs.

The card slot 53S is structured so as to allow the memory card 53 to be attached/detached to/from the card slot 53S. This card slot 53S is connected to the motherboard 40 through an IDE bus. Thus, the type and content of a game run by a gaming terminal 10 can be modified by detaching the memory card 53 from the card slot 53S, writing a different game program and a different game system program into the memory card 53, and inserting the memory card 53 back into the card slot 53S.

Each of the game programs includes a program related to the progress of the game and/or a program for causing a transition to a bonus game. Each of the game programs includes image data and audio data output during the game.

The GAL 54 has input and output ports. When the GAL 54 receives data via the input port, it outputs data corresponding to the input data from its output port. This data from the output port is the payout rate setting data described above.

IC socket 54S is structured so as to allow the GAL 54 to be attached/detached to/from the IC socket 54S. The IC socket 54S is connected to the motherboard 40, via a PCI bus. Thus, the payout rate setting data to be output from GAL 54 can be modified by: detaching the GAL 54 from the IC socket 54S, overwriting the program stored in the GAL 54, and attaching the GAL 54 back to the IC socket 54S.

The CPU 51, the ROM 55 and the boot ROM 52 connected through an internal bus are connected to the motherboard 40 through the PCI bus. The PCI bus communicates signals between the motherboard 40 and the gaming board 50 and supplies power from the motherboard 40 to the gaming board 50. The ROM 55 stores country identification information and an authentication program. The boot ROM 52 stores a preliminary authentication program and a program (boot code) for enabling the CPU 51 to run the preliminary authentication program.

The authentication program is a program (falsification check program) for authenticating the game program and the game system program. The authentication program is a program for confirming and verifying that the game program and the game system program are not falsified. In other words, the authentication program is described in accordance with a procedure for authenticating the game program and the game system program. The preliminary authentication program is a program for authenticating the authentication program. The preliminary authentication program is described in accordance with a procedure for verifying that the authentication program to be authenticated is not falsified. In short, the preliminary authentication program authenticates the authentication program.

The motherboard 40 is provided with a main CPU 41 (terminal controller 100), a ROM (Read Only Memory) 42, a RAM (Random Access Memory) 43, and a communication interface 44.

The main CPU 41 serves as a terminal controller 100 and has a function of controlling the entire gaming terminal 10. In particular, the main CPU 41 controls the following operations: an operation of outputting a signal instructing variable-displaying of symbols 180 to the graphic board 68, which is performed in response to pressing of the spin button 23 after betting of credit; an operation of determining symbols 180 to be stopped after the variable-displaying of symbols 180; and an operation of stopping the symbols 180 thus determined in the display window 151 to 155.

In other words, the main CPU 41 serves as an arrangement controller which rearranges symbols to form a new symbol matrix through scrolling of symbols displayed on the lower image display panel 16. This main CPU 41 therefore determines symbols to be arranged in a symbol matrix by selecting symbols to be arranged from various kinds of symbols. Then, the main CPU 41 executes arrangement control to stop scrolling the symbols to present the symbols thus determined.

Note that the main CPU 41 includes: a game running unit 103 of FIG. 5, a display control unit 102, a payout determining unit 105, a terminal emission control unit 109, and a payout awarding unit 104.

The ROM 42 stores a program such as BIOS (Basic Input/Output System) run by the main CPU 41, and permanently-used data. When the BIOS is run by the main CPU 41, each of peripheral devices is initialized and the game program and the game system program stored in the memory card 53 are read out through the gaming board 50.

The RAM 43 stores data or a program used for the main CPU 41 to perform a process. For example, the RAM 43 includes, in the form of data area, a symbol storage unit 108 of FIG. 5, a display storage unit 107, a table storage unit 106, or the like. Further, the data area serving as the table storage unit 106 stores the winning combination table of FIG. 13, and the base game payout table of FIG. 14.

The communication interface 44 is provided to communicate with a host computer and the like equipped in the game arcade, through the network(communication line). The communication interface 44 is also for communicating with the JP controller 200 through a communication line. Further, a main body PCB (Printed Circuit Board) 60 and a door PCB 80 are connected to the motherboard 40, through USB (Universal Serial Bus). Further, the motherboard 40 is connected to a power unit 45. The power unit 45 supplies power to the motherboard 40 to boot the main CPU 41 thereof. Meanwhile, the power unit 45 supplies power to the gaming board 50 through the PCI bus to boot the CPU 51 thereof.

The main body PCB 60 and door PCB 80 are connected to various devices or units which generate control signals to be input to the main CPU 41, and various devices or units whose operations are controlled by signals from the main CPU 41. Based on a signal input to the main CPU 41, the main CPU 41 runs the game program and the game system program stored in the RAM 43, to perform an arithmetic process. Then, the CPU 41 stores the result of the arithmetic process in the RAM 43, or transmits a control signal to the various devices and units to control them based on the result.

The main body PCB 60 is connected with the cabinet light emitting portions 30, a hopper 66, a coin sensor 67, a graphic board 68, the speaker 29, a bill validator 22, a ticket printer 35, a card reader 36, a key switch 38S, and a data displayer 37.

The cabinet light emitting portions 30 is turned on/off on the basis of a control signal from the main CPU 41.

The hopper 66 is mounted in the cabinet 11 and pays out a predetermined number of coins from a coin outlet 19 to the coin tray 18, based on a control signal from the main CPU 41. The coin sensor 67 is provided inside the coin outlet 19, and outputs a signal to be input to the main CPU 41 upon sensing that a predetermined number of coins have been delivered from the coin outlet 19.

The graphic board 68 controls image displaying of upper image display panel 33 and the lower image display panel 16, based on a control signal from the main CPU 41. Further, the graphic board 68 is provided with a VDP (Video Display Processor) for generating image data on the basis of a control signal from the main CPU 41, a video RAM for temporarily storing the image data generated by the VDP, or the like. Note that image data used at the time of generating the image data by the VDP is in a game program which is read out from the memory card 53 and stored in the RAM 43.

The bill validator 22 reads an image on the bill and takes only those recognized as to be genuine into the cabinet 11. When taking in a genuine bill, the bill validator 22 outputs an input signal indicating the value of the bill to the main CPU 41. The main CPU 41 stores into the RAM 43 a credit value corresponding to the value of the bill indicated by the signal input.

The ticket printer 35 prints a barcode onto a ticket to issue a ticket 39 having the barcode. The barcode contains encoded data such as credit value stored in the RAM 43, date and time, identification number of the gaming terminal 10, or the like, based on a control signal from the main CPU 41.

The card reader 36 reads out data from the smart card and transmits the data to the main CPU 41. Further, the card reader 36 writes data into the smart card based on the control signal output from the main CPU 41. The key switch 38S is mounted to the keypad 38, and outputs a signal to the main CPU 41 in response to an operation of the keypad 38 by the player. The data displayer 37 displays, based on a control signal from the main CPU 41, the data read by the card reader 36 or the data input by the player through the keypad 38.

The door PCB 80 is connected to a control panel 20, a reverter 21S, a coin counter 21C, and a cold cathode tube 81. The control panel 20 is provided with: a spin switch 23S associated with the spin button 23; a change switch 24S associated with the change button 24; a cashout switch 25S associated with the cashout button 25; a 1-BET switch 26S associated with the 1-BET button 26; and a maximum BET switch 27S associated with the maximum BET button 27. Each of the switches 23S to 27S outputs a signal to the main CPU 41, when a player presses the associated button.

The coin counter 21C is provided within the coin insertion slot 21, and identifies whether the coin inserted into the coin insertion slot 12 by the player is genuine. A coin except the genuine coin is discharged from the coin outlet 19. In addition, the coin counter 21C outputs an input signal to the main CPU 41 upon detection of a genuine coin.

The reverter 21S is operated on the basis of the control signal output from the main CPU 41 and distributes a coin, which is recognized as a genuine coin by the coin counter 21C, to a not-shown cash box or hopper 66 mounted in the gaming terminal 10. In other words, when the hopper 66 is full of the coins, the genuine coin is distributed into the cash box by the reverter 21S. On the other hand, when the hopper 66 is not yet full with the coins, the genuine coin is distributed into the hopper 66. The cold cathode tube 81 functions as a backlight mounted to rear sides of the lower image display panel 16 and the upper image display panel 33. This cold cathode tube 81 turns on according to a control signal from the main CPU 41.

(Electrical Structure of JP Controller 200)

FIG. 12 is a block diagram illustrating an electrical structure of the JP controller 200. The JP controller 200 is provided therein with a control unit. As illustrated in FIG. 12, the control unit includes a motherboard 240, a gaming board 250, an actuator, or the like.

The gaming board 250 has the same structure as that of the gaming board 50. The motherboard 240 has the same structure as that of the motherboard 40.

The motherboard 240 has a main CPU 241, ROM 242, and RAM 243.

The main CPU 241 includes a JP game running unit 203 of FIG. 5, a JP timer 208, a JP emission control unit 209, and a JP payout determining unit 205.

The ROM 242 stores a program such run by the main CPU 241, and permanently-used data.

The RAM 243 stores data or a program used for the main CPU 241 to perform a process. For example, in the RAM 243 are provided a progressive storage unit 207 of FIG. 5, a JP table storage unit 206, and emission pattern table storage unit 204 in the form of data area. Further, in the data area serving as the progressive storage unit 207 is stored the progressive value table of FIG. 16. In the data area serving as the JP table storage unit 206 is stored the race-use light emitting portion activation table for straight part and curves respectively illustrated in FIG. 15. In the data area of the emission pattern table storage unit 204 is stored a light emitting portion emission pattern table illustrated in FIG. 17.

Further, the JP controller 200 includes, as a main actuator, the JP payout indicator 400, the race-use light emitting portions 2, and the effect-use light emitting portions 530.

The JP payout indicator 400 displays, in response to a control signal output from the main CPU 241, the JP payout based on the progressive values collected from the gaming terminals 10.

The race-use light emitting portions 2 and effect-use light emitting portions 530 light or blink based on a control signal output from the main CPU 241.

Further, the JP controller 200 has a power unit 245 and a communication interface 244.

The power unit 245 has a function of supplying the power to the motherboard 240. The communication interface 244 communicates with the terminal controller 100 of each gaming terminal 10 through a communication line.

(Winning Combination Table)

FIG. 13 is a diagram illustrating the winning combination table. The winning combination table is stored in the RAM 43 of each gaming terminal 10, and has a "winning combination" field and a "random number" field. The "winning combination" field stores a list of combinations for achieving a winning in the base game, and the "random number" field stores a list of a random numbers corresponding to various winning combinations. For example, one of the winning combinations of symbols 180 is one with "Coelacanth". The random numbers allotted to the combination ranges from 0 to 49. Note that, in the present invention, the winning combinations and the range of the random numbers respectively allotted thereto are not limited to those in the winning combination table shown in FIG. 13. Further, the similar table is used for JP winning combinations of the JP game and the range of random numbers respectively allotted to the JP winning combinations, in the present embodiment. However, the present invention is not limited to this, and different types of tables may be used for the base game and JP game respectively.

(Base Game Payout Table)

FIG. 14 shows a base game payout table. The base game payout table is stored in the RAM 43 of each gaming terminal 10, and has a "winning combination" field and a "payout" field. The "winning combination" field stores a list of combinations for achieving a winning in the base game, and the "payout" field stores a list of payout amounts respectively corresponding to the combinations. For example, a winning with the combination of "Coelacanth" yields the highest payout, and 50 coins are awarded to the player every time this combination is formed. Further, the combination of "Loss" awards zero coins (i.e. no payout) to the player. Note that the payouts to be listed in the base game payout table are not limited to those in FIG. 14 in the present invention.

(Race-Use Light Emitting Portion Activation Table)

FIG. 15 illustrates the race-use light emitting portion activation table. This table is stored in the RAM 243 of the JP controller 200, and has a "JP winning combination" field and a "race-use light emitting portion activation count " field. Further, the "race-use light emitting portion activation count" field includes a "curve" field and "straight part" field. Further, the "curve" field is divided into three groups: "Gr. 1", "Gr. 2", and "Gr. 3". The "straight part" field has a "common" field. The "JP winning combination" field stores a list of combinations for achieving a JP winning in the JP game, and the "race-use light emitting portion activation count" field stores a list of the numbers of the race-use light emitting portions 2 to be lighted, which numbers respectively correspond to various JP winnings. This table is referred to when activating the race-use light emitting portions 2 during the JP game. The number of the race-use light emitting portions 2 to be activated in the curves 300*a* is set differently in each of the groups. For example, when a JP winning combination of "Coelacanth" is formed, the number of the race-use light emitting portions 2 to turn active is five for Gr. 1 and Gr. 2, and four for gr. 3. Further, when the JP winning combination of "Angelfish" is formed, the number of the race-use light emitting portions 2 to turn active is four for Gr. 1, and three for Gr. 2 and Gr. 3. As is obvious from the above, even when the same JP winning is achieved, the number of race-use light emitting portions 2 to turn active differs depending on the groups determined in relation to the length of the curve 300*a*. If all the curve 300*a* has the same length in the present invention, the grouping is not necessary. Therefore, setting the number of the race-use light emitting portions 2 to turn active does not have to be set for each of the groups.

The setting related to the "straight part" field is the same in all the gaming terminal 10 irrespective of which group each gaming terminal 10 belongs to. For example, when a JP winning of the "Coelacanth" is achieved, three race-use light emitting portions 2 turn active for each of the gaming terminals 10.

(Progressive Value Table)

FIG. 16 illustrates a progressive value table. The progressive value table is stored in the RAM 243 of the JP controller 200 and has a "group name" field, and an "emission color setting" field. The table further has an "individual progressive value" field and a "total progressive value" field. The "individual progressive value" field stores a progressive value collected from a gaming terminal 10. The "total progressive value" field stores a total of progressive values collected from all the gaming terminals 10.

The "group name" field stores a list of group names which are associated with the gaming terminals 10 according to the length of the curve 300*a*. The "emission color setting" field stores information of emission color of the cabinet light emitting portions 30 and that of the race-use light emitting portions 2 in relation to each of the gaming terminals 10. In the "individual progressive value" field, a progressive value collected from a gaming terminal 10 during the base game is stored in association with that gaming terminal 10. The progressive value is accumulatively stored every time a progressive value is collected from a gaming terminal 10. Note that the "emission color setting" field is determined based on the amount of the associated progressive value stored in the "individual progressive value" field. For example, the progressive value associated with the gaming terminal 10 given the terminal ID of "D" in the "individual progressive value" field is "50". Further, the "emission color setting" field for that gaming terminal 10 is set to "amber". The progressive values stored in the "individual progressive value" field in association with the "terminal B" and "terminal J" are both "30". In such a case, the "emission color setting" field for the both gaming terminals 10 are also the same.

Further, every time a progressive value in the "individual progressive value" field is updated, all the progressive values given by the gaming terminals 10 are summed up and the resulting total progressive value is stored in the "total progressive value" field. Note that the JP game is run when the total progressive value in the "total progressive value" field reaches a predetermined value (e.g. 300).

(Light Emitting Portion Emission Pattern Table)

FIG. 17 illustrates the light emitting portion emission pattern table. The light emitting portion emission pattern table is stored in the RAM 243 of the JP controller 200, and has a "terminal ID" field, a "race-use light emitting portion blinking position" field, and an "effect-use light emitting portion blinking position" field.

The "terminal ID" field stores information on a terminal ID of each gaming terminal 10. In the "race-use light emitting portion blinking position" field, two pieces of information "curve" and "straight part" are associated for each item of the "terminal ID" field. Further, the "effect-use light emitting portion blinking position" field stores information on a blinking position of the effect-use light emitting portions 530 in relation to the number of the race-use light emitting portions 2 to blink. For example, when(i) three race-use light emitting portions 2 associated with the gaming terminal 10E or 10F are blinking; and (ii) the blinking race-use light emitting portions 2 are in the curve 300*a*, the effect-use light emitting portions 530 in the race cabinet 520*b* (position ②) blink in sync with the race-use light emitting portions 2 and the cabinet light emitting portions 30. On the other hand, when the blinking race-use light emitting portions 2 are in the straight part 300*b*, the effect-use light emitting portions 530 in all the race cabinets 520 (positions ①, ②, and ①) blink in sync with the race-use light emitting portions 2 and the cabinet light emitting portions 30. That is, at a time of activating the race-use light emitting portions 2 in the curve 300*a* during the JP game, the effect-use light emitting portions 530 in the race cabinet 520 above the corresponding gaming terminal 10 blink in sync with the cabinet light emitting portions 30 and the race-use light emitting portions 2. On the other hand, at a time of activating the race-use light emitting portions 2 in the straight part 300*b* during the JP game, the effect-use light emitting portions 530 in all the race cabinets 520 blink in sync with the cabinet light emitting portions 30 of the corresponding gaming terminal 10 and the associated race-use light emitting portions 2. Thus, when race-use light emitting portions 2 in the straight part 300*b*, more effect-use light emitting portions 530 blink in sync with the race-use light emitting portions 2, as compared with the case of blinking the race-use light emitting portions 2 in the curve 300*a*. Accordingly, players are able to grasp at one glance which race-use light emitting portions 2 is activated.

Further, the light emitting portion emission pattern table illustrated in FIG. 17 stores information of pre-set race-use light emitting portions 2. For example, when three race-use light emitting portions are blinking, the illuminance is set to 1600 lux, whereas the illuminance is 2000 lux when five race-use light emitting portions 2 are blinking. Accordingly, by setting the illuminance so that the larger the number of the race-use light emitting portions 2 blinking, the brighter the race-use light emitting portions 2 blink, it may be possible to allow players to easily grasp the number of the associated race-use light emitting portions 2 blinking.

[Operation of Gaming Machine 1: Boot Process]

The following describes a boot process routine which takes place in the gaming machine 1. Upon powering on the gaming machine 1, a boot process routine shown in FIG. 18 starts in: the motherboard 240 and gaming board 250 in the JP controller 200, and in the motherboard 40 and the gaming board 50 in the terminal controller 100. The memory cards 53 and 253 are assumed to be inserted into the card slots 53S and 253S of the gaming boards 50 and 250, respectively. Further, the GALs 54 and 254 are assumed to be attached to the IC sockets 54S and 254S, respectively.

First, turning on the power switch of (powering on) the power units 45 and 245 boots the motherboards 40 and 240, and the gaming boards 50 and 250. Booting the motherboards 40 and 240 and the gaming boards 50 and 250 starts separate processes in parallel. Specifically, in the gaming board 50 and 250, the CPUs 51 and 251 read out preliminary authentication programs stored in the boot ROMs 52 and 252, respectively. Then, preliminary authentication is performed according to the read out programs so as to confirm and authenticate that no modification is made to authentication programs, before reading them in the motherboards 40 and 240, respectively (S1). Meanwhile, the main CPUs 41 and 241 of the motherboards 40 and 240 run BIOS stored in the ROMs 42 and 242 to load into the RAMs 43 and 243 compressed data built in the BIOS, respectively (S2). Then, the main CPUs 41 and 241 run a procedure of the BIOS according to the data loaded into the RAMs 43 and 243 so as to diagnose and initialize various peripheral devices (S3).

The main CPUs 41 and 241, which are respectively connected to the ROMs 55 and 255 of the gaming boards 50 and 250 via PCI buses, read out authentication programs stored in the ROMs 55 and 255 and stores them in the RAMs 43 and 243 (S4). During this step, the main CPUs 41 and 241 each derives a checksum through ADD SUM method (a standard check function) which is adopted in a standard BIOS, and store the authentication programs into RAMs 43 and 243 while confirming if the operation of storing is carried out without an error.

Next, the main CPUs 41 and 241 each checks what connects to the IDE bus. Then, the main CPUs 41 and 241 access, via the IDE buses, to the memory cards 53 and 253 inserted into the card slots 53S and 253S, and read out game programs and game system programs from the memory cards 53 and 253, respectively. In this case, the CPUs 41 and 241 each reads out four bytes of data constituting the game program and the game system program at one time. Next, according to the authentication programs stored in the RAMs 43 and 243, the CPUs 41 and 241 authenticate the game program and the game system program read out to confirm and prove that these programs are not modified (S5).

When the authentication properly ends, the main CPUs 41 and 241 write and store the authenticated game programs and game system programs in RAMs 43 and 243 (S6).

Next, the main CPUs 41 and 241 access, via the PCI buses, to the GALs 54 and 254 attached to the IC socket 54S 254S, and read out payout rate setting data from the GALs 54 and 254, respectively. The payout rate setting data read out is then written and stored in the RAMs 43 and 243 (S7).

Next, the main CPUs 41 and 241 readout, via the PCI buses, country identification information stored in the ROMs 55 and 255 of the gaming boards 50 and 250, respectively. The country identification information read out is then stored in the RAMs 43 and 243 (S8).

Figure 19:
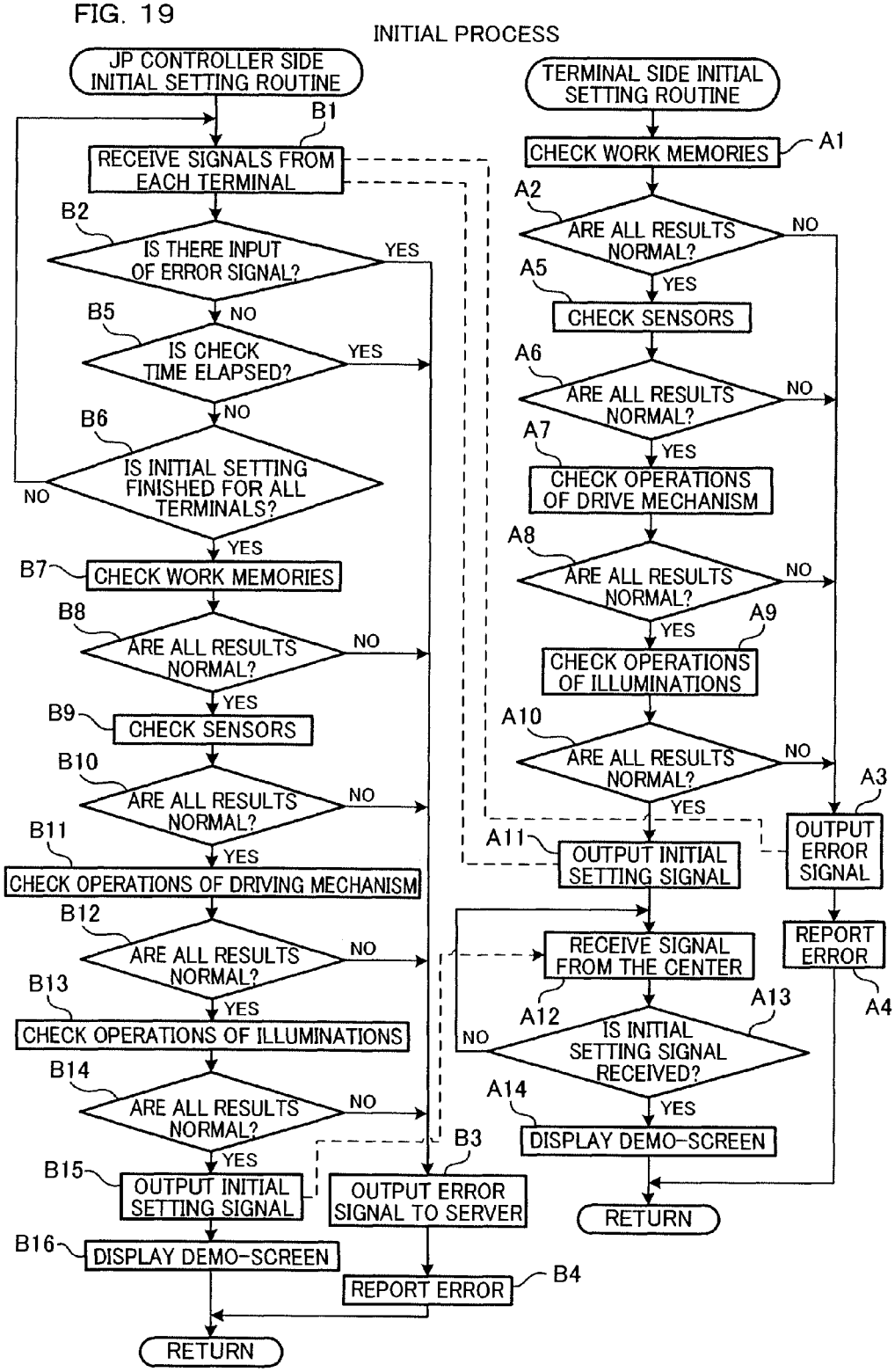
FIG. 19 is a flowchart illustrating an initial process executed by the gaming terminal and the JP controller.

After this, the main CPUs 41 and 241 each perform an initial process of FIG. 19.

[Operation of Gaming Machine 1: Initial Process]

Figure 18:
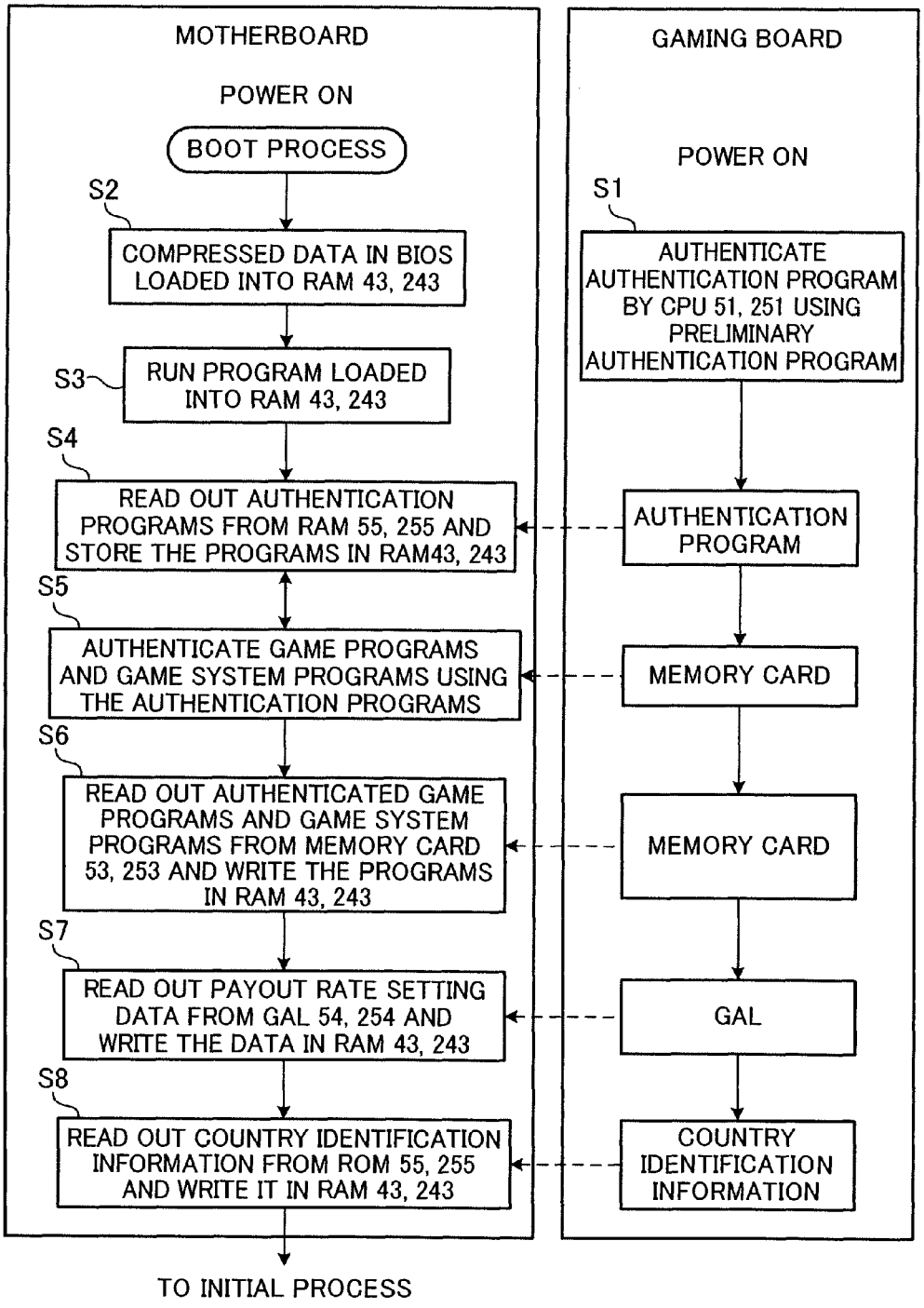
FIG. 18 is a flowchart illustrating a boot process executed by the gaming terminal and the JP controller.

The following describes an initial process which takes place in the gaming machine 1. When the boot process of FIG. 18 is completed, the JP controller 200 reads out from the RAM 243 a JP controller side initial setting routine illustrated in FIG. 19 and executes the routine. Meanwhile, the gaming terminal 10 reads out from the RAM 43 a terminal side initial setting routine illustrated in FIG. 19 and executes the routine. The JP controller side and terminal side initial setting routines are executed in parallel.

First, the main CPU 41 of the gaming terminal 10 checks the operation of work memories such as RAM 43 (A1). Then, the main CPU 41 determines if all the check results are normal (A2). If the main CPU 41 determines that the check results contains an error (A2: NO), the main CPU 41 outputs a signal notifying the error (hereinafter, error signal) to the JP controller 200 (A3). Further, the main CPU 41 reports the error in the form an alarm sound from a speaker 29 or the like (A4), and then ends the routine.

On the other hand in A2, if the main CPU 41 determines that all the check results are normal (A2: YES), the main CPU 41 checks the operations of various sensors (A5). Then, the main CPU 41 determines if all the check results are normal (A6). If the main CPU 41 determines the check results contain an error (A6: NO), the main CPU 41 executes A3.

On the other hand in A6, if the main CPU 41 determines that all the check results are normal (A6: YES), the main CPU 41 checks the operations of various driving mechanisms (A7). Then, the main CPU 41 determines if all the check results are normal (A8). If the main CPU 41 determines the check results contain an error (A8: NO), the main CPU 41 executes A3.

On the other hand in A8, if the main CPU 41 determines that all the check results are normal (A8: YES), the main CPU 41 checks the operations of various illuminations (A9). Then, the main CPU 41 determines if all the check results are normal (A10). If the main CPU 41 determines the check results contain an error (A10: NO), the main CPU 41 executes A3.

If the main CPU 41 determines that all the check results are normal (A10: YES) in the above process of checking various operations and functions through A1 to A10, the main CPU 41, an initial setting signal is output to the JP controller 200 (A11). Then, an initial setting signal is waited from the JP controller 200 (A12, A13: NO).

The main CPU 41 of the JP controller 200 receives signals from each of the gaming terminals 10 (B1). Then, the main CPU 241 determines whether a signal received is an error signal (B2). If the main CPU 241 determines that the signal is an error signal (B2: YES), the main CPU 241 outputs the error signal to a server of a not-shown host computer or the like (B3) to report the error (B4), and ends the routine.

On the other hand in B2, if the main CPU 241 determines that the signal is not an error signal (B2:NO), the main CPU 241 determines whether a predetermined time (check time) has elapsed from the time of powering on (B5). If the main CPU 241 determines that the check time has elapsed (B5: YES), B3 is executed. On the other hand, if the main CPU 241 determines that the checktime has not yet elapsed (B5:NO), it is determined whether an initial setting signal is received from each of the gaming terminals 10 (B6). If the main CPU 241 determines that an initial setting signal from any one of the gaming terminals 10 is not received (B6: NO), the process returns to B1.

On the other hand if the main CPU 241 determines that an initial setting signal is received from any of the gaming terminals 10 (B6: YES), the main CPU 241 checks the operation of work memories such as RAM 243 (B7). Then, the main CPU 241 determines whether all the check results are normal (B8). If the main CPU 241 determines the check results contain an error (B8: NO), the main CPU 241 executes B3.

On the other hand in B8, if the main CPU 241 determines that all the check results are normal (B8: YES), the main CPU 241 checks the operations of various sensors (B9). Then, the main CPU 241 determines whether all the check results are normal (B10). If the main CPU 241 determines the check results contain an error (B10: NO), the main CPU 241 executes B3.

On the other hand in A6, if the main CPU 241 determines that all the check results are normal (B10: YES), the main CPU 241 checks the operations of various driving mechanisms (B11). Then, the main CPU 241 determines whether all the check results are normal (B12). If the main CPU 241 determines the check results contain an error (B12: NO), the main CPU 241 executes B3.

On the other hand in B12, if the main CPU 241 determines that all the check results are normal (B12: YES), the main CPU 241 checks the operations of various illuminations (B13). Then, the main CPU 241 determines whether all the check results are normal (B14). If the main CPU 241 determines the check results contain an error (B14: NO), the main CPU 241 executes B3.

If the main CPU 241 determines that all the check results are normal (B14: YES) in the above process of checking various operations and functions through B7 to B14, the main CPU 241 outputs an initial setting signal to all the gaming terminals 10 (B15), and causes the shared display 510 to display a demo-screen (B16). Then, the main CPU 241 ends the routine.

In A12, the main CPU 41 of each of the gaming terminals 10 determines that an initial setting signal is received from the JP controller 200 (A13: YES), and causes the terminal display 101 to display a demo-screen (A14). The main CPU 41 then ends the routine.

Operation of Gaming Terminal 10: Game Running Process Routine) After the terminal side initial setting routine of FIG. 19, the main CPU 41 of the gaming terminal 10 performs a game running process routine of FIG. 20. Through this game running process routine executed by the main CPU 41, a game is progressed.

Figure 20:
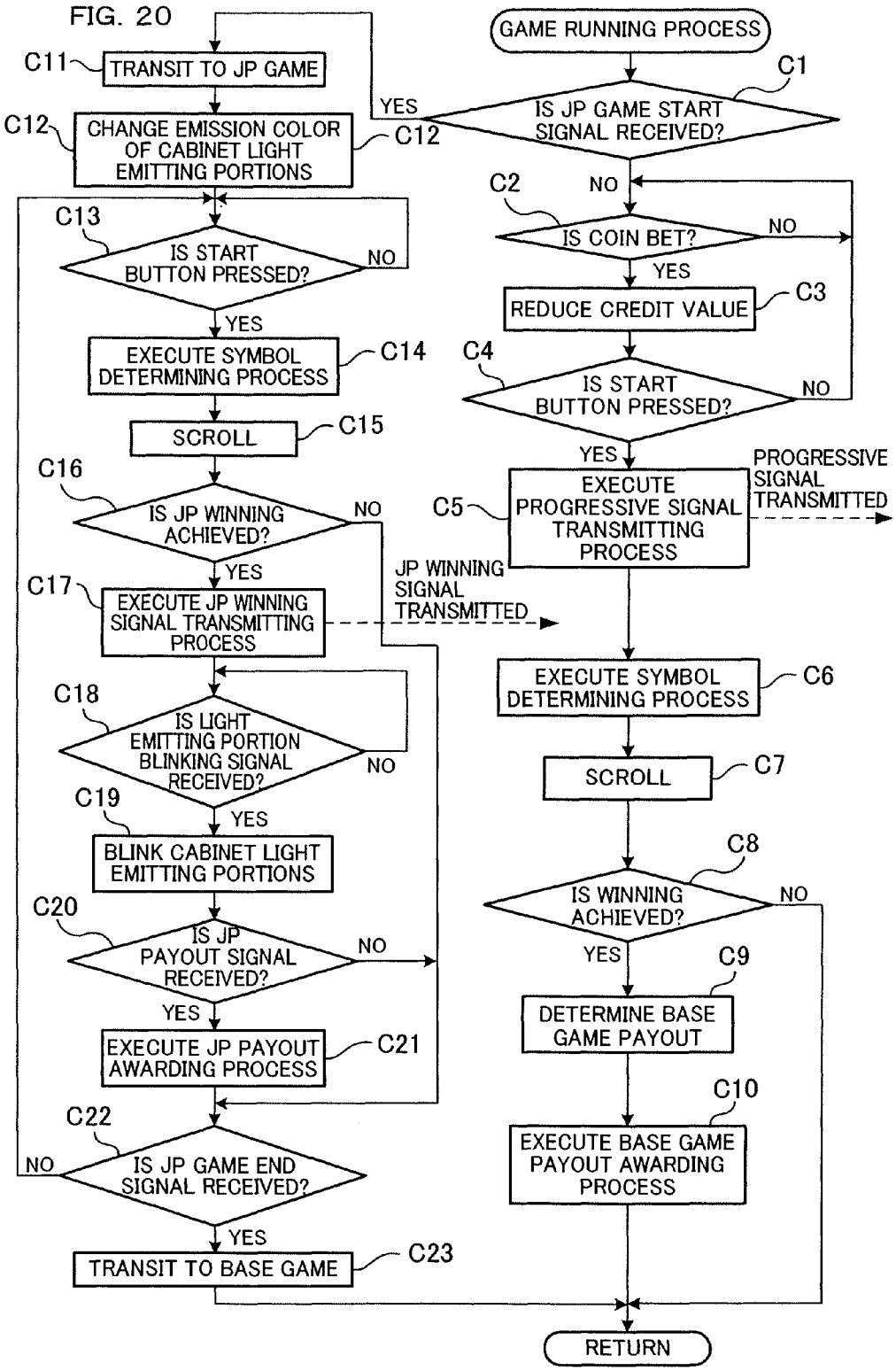
FIG. 20 is a flowchart illustrating a game running process routine executed in the gaming terminal.

As illustrated in FIG. 20, whether or not a JP game start signal is received from the JP controller 200 is determined in the game running process routine (Cl). If no JP game start signal is received (C1: NO), whether or not a bet of a coin is made is determined (C2). In this step, it is determined whether a signal from the 1-BET switch 26S entered by pressing of the 1-BET button 26 is received. Meanwhile, it is determined whether a signal from the maximum BET switch 27S entered by pressing of the maximum BET button 27 is received. If no coin is BET (C2: NO), C2 is repeated until a coin is bet.

On the other hand, if a coin is bet (C2: YES), the credit value stored in the RAM 43 is reduced according to the number of coins bet (C3). When the number of coins bet surpasses the number of coins equivalent to the credit value stored in the RAM 43, C4 is repeated without the reduction of the credit value. When the number of coins bet exceeds the maximum number of coins bettable one game (50 pieces in this embodiment), the process goes to C4 without the reduction of the credit value.

Then, it is determined whether a spin button 23 is pressed (C4). If the spin button 23 is not pressed (C4: NO), the process returns to C2. Here, if the spin button 23 is not pressed (for example, the spin button 23 is not pressed but a command to end the game is input), the reduction of the credit value in C3 is canceled.

On the other hand, if the spin button 23 is pressed (turned to the ON state) (C4: YES), the progressive transmitting process is executed (C5). That is, a progressive signal indicative of a progressive value having been bet is transmitted to the JP controller 200.

Next executed is a symbol determining process for a base game (C6). That is, the stop symbol determining program stored in the RAM 43 is run to determine symbols 180 to be arranged in the matrix 156. Through this, a symbol combination to be formed along the payline L is determined.

Then, the scrolling process is executed to scroll symbols 180 on the terminal display 101 (C7). The scrolling process is a process in which the symbols 180 determined in C6 are stopped (rearranged) in the matrix 156 after scrolling of symbols 180 in a direction indicated by an arrow symbol.

Next, it is determined whether a combination formed by symbols 180 rearranged in the matrix 156 achieves a winning (C8). If it is determined that a winning is achieved (C8: YES), a payout for the winning achieved in the base game is determined (C9). Next executed is a process of awarding the payout determined in C9 (C10). More specifically, the number of coins according to the winning is calculated. On the other hand, if it is determined that no winning has been achieved (C8: NO), this routine is ended.

In C1, if a JP game start signal is received from the JP controller 200 (C1: YES), a JP game is run instead of the base game (C11). At that time, the emission color of the cabinet light emitting portions 30 is modified based on the information in the JP game start signal (C12).

Then, it is determined whether a spin button 23 is pressed (C13). If it is determined that the spin button 23 is not pressed (C13: NO), pressing of the spin button 23 is waited.

On the other hand, if it is determined that the spin button 23 is pressed (C13:YES), the symbol determining process for JP game is executed (C14). Then, the scrolling process is executed to scroll symbols 180 on the terminal display 101 (C15).

Next, it is determined whether a combination of symbols 180 rearranged in the matrix 156 achieves a JP winning (C16). If it is determined no JP winning has been achieved (C16:NO), whether or not a JP game end signal is received from the JP controller 200 is determined (C22).

If it is determined that no JP game end signal is received (C22:NO), C13 is re-executed. On the other hand, if it is determined that the JP game end signal is received (C22: YES), the JP game ends and a transition to the base game occurs (C23) Then, this routine ends.

In C16, if it is determined that a JP winning is achieved (C16:YES), a JP winning signal is transmitted to the JP controller 200 (C17). Next, there is determined whether or not a light emitting portion blinking signal is received from the JP controller 200 (C18). If it is determined that no light emitting portion blinking signal is received (C18' NO), the process returns to C18, and the reception of the light emitting portion blinking signal is waited. On the other hand, if it is determined that the light emitting portion blinking signal is received (C18: YES), the cabinet light emitting portions 30 are turned active to blink for several seconds based on the information on the emission pattern contained in the light emitting portion blinking signal (C19). Next, whether or not a JP payout signal is received from the JP controller 200 is determined (C20). If it is determined that no JP payout signal is received (C20: NO), C22 is executed. If it is determined that a JP payout signal is received (C20:YES), a JP payout is awarded based on the information in the JP payout signal (C21). At that time, the upper image display panel 33B of the gaming terminal 10B indicates that a Jackpot has been achieved. C22 is executed thereafter.

(Process Operation of JP Controller 200: Progressive Value Adding Process Routine)

Figure 21:
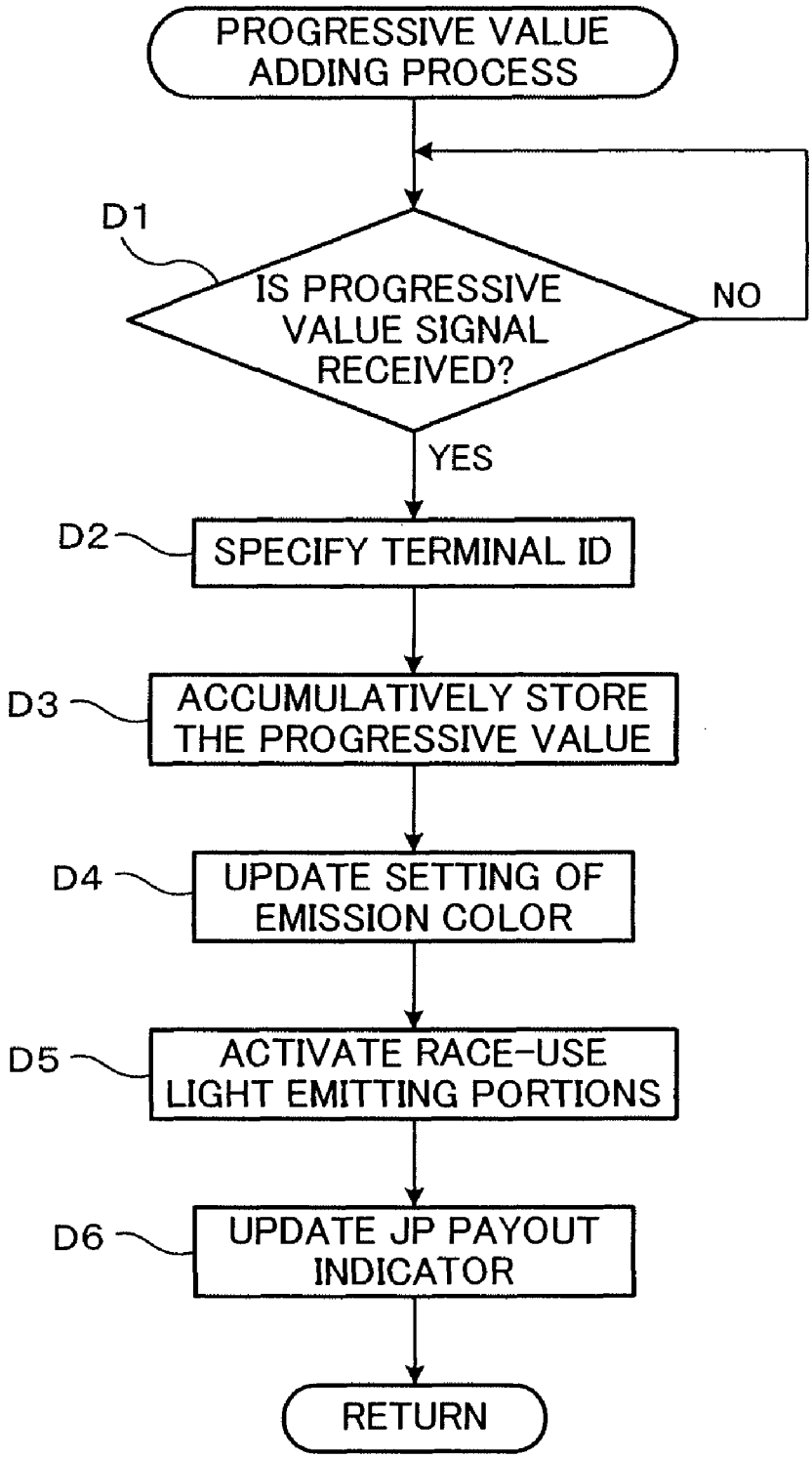
FIG. 21 is a flowchart illustrating a progressive value adding process routine executed by the JP controller.

FIG. 21 illustrates a progressive value adding process routine taking place in the JP controller 200. When the progressive value adding process routine is executed, the JP controller 200 determines whether or not a progressive signal is received from the terminal controller 100 of a gaming terminal 10 (D1). When the JP controller 200 determines that no progressive signal is received (D1; NO), the progressive signal is waited (D1).

In D1, if the JP controller 200 determines that a progressive signal is received from the terminal controller 100 (D1:YES), the terminal ID assigned to the gaming terminal 10 having sent the progressive signal is specified based on the progressive signal received (D2), and the progressive value obtained is accumulatively stored in the RAM 243 (D3). At that time, the progressive value obtained is stored in the "individual progressive value" field of the progressive value table illustrated in FIG. 16. The "emission color setting" field of the progressive value table is then updated based on the amount of the progressive value stored in the "individual progressive value" field (D4). Next, according to the amount of the progressive value obtained, a predetermined number of the race-use light emitting portions 2 associated with the gaming terminal 10 specified in D2 are turned active (D5). Further, the total of all the progressive values obtained from the gaming terminals 10 is updated and displayed on the JP payout indicator 400 (D6). This routine ends thereafter.

(Operation of JP controller 200: JP Game Running Process Routine)

Figure 22:
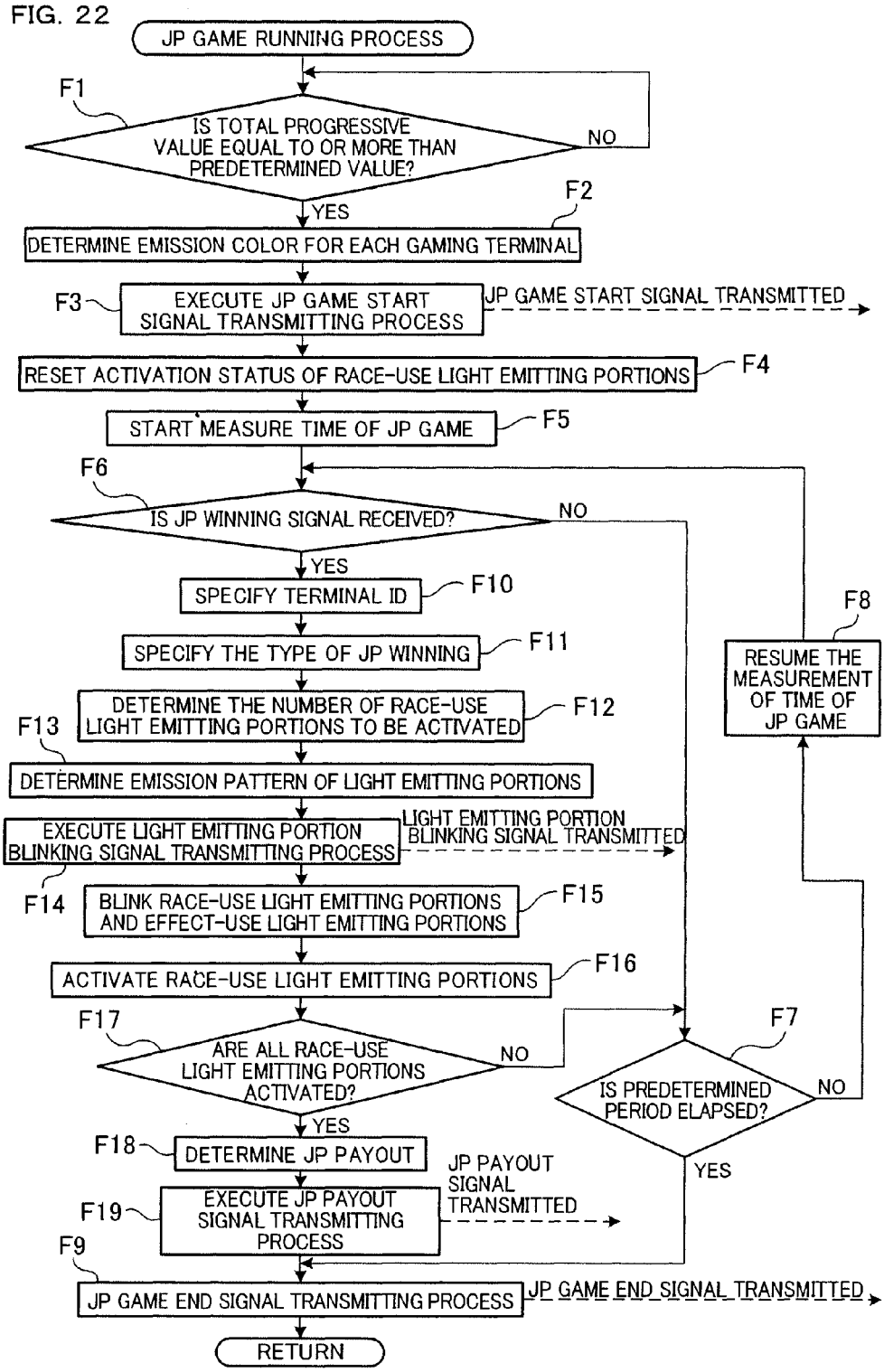
FIG. 22 is a flowchart illustrating the JP game running process routine executed by the JP controller.

FIG. 22 illustrates a JP game running process routine which takes place in the JP controller 200. When the JP game running process routine is executed, the JP controller 200 refers to the "total progressive value" field of the progressive value table FIG. 16 which is stored in RAM 243, so as to determine whether or not the total of the progressive values obtained from the gaming terminals 10 equals or surpasses a predetermined value (F1). If it is determined that the total is less than the predetermined value (F1: NO), F1 is repeated until the total reaches the predetermined value.

On the other hand in F1, if it is determined that the total equals or surpasses the predetermined value (F1: YES), the "individual progressive value" field of the progressive value table is referred to so as to determine, for each gaming terminal 10, the emission color of the cabinet light emitting portions 30 and that of the race-use light emitting portions 2. In other words, the emission color of the cabinet light emitting portions 30 and that of the race-use light emitting portions 2 associated with the gaming terminals 10 are determined based on the corresponding contribution level during the base game (F2).

In F2, when the emission colors are determined for each gaming terminal 10, a JP game start signal is transmitted to all the gaming terminals 10 connected (F3). Note that the JP game start signal contains information that causes a start of the JP game and information of the emission colors determined in F2.

Next, the race-use light emitting portions 2 having turned active during the base game, according to the progressive value obtained are all reset; i.e., D5 of the progressive value adding process routine shown in FIG. 21 is reset (F4). Then, time measurement of the JP game starts (F5)

Next, whether or not a JP winning signal is received from any of the gaming terminals 10 is determined. If it is determined that no JP winning signal is received (F6: NO), whether a predetermined period has elapsed since the start of the time measurement in F5 is determined (F7). If the predetermined period has not yet elapsed (F7: NO), the time measurement resumes (F8), and the process returns to F6. On the other hand in F7, if it is determined that the predetermined period has elapsed (F7: YES), a JP game end signal is transmitted to the gaming terminals 10 (F9). This routine ends thereafter.

In F6, if it is determined that a JP winning signal is received from a gaming terminal 10 (F6: YES), the terminal ID of the gaming terminal 10 is specified based on the JP winning signal received (F10). Further, the combination of the JP winning having formed in the JP game played on the gaming terminal 10 is derived based on the JP winning signal received (F11). Then, referring to the race-use light emitting portion activation table for straight part and curve respectively illustrated in FIG. 15, the number of the race-use light emitting portions 2 to turn active is determined based on the JP winning combination derived in F11 (F12). Next, referring to the light emitting portion emission pattern table illustrated in FIG. 17, the emission pattern is determined based on the combination of the JP winning derived in F11 (F13). Then, a light emitting portion blinking signal including information on the emission pattern thus determined in F13 is output to the gaming terminal 10 whose terminal ID is specified in F10 (F14). After that, the race-use light emitting portions 2 and the effect-use light emitting portions 530 blink in sync with each other (F15), and the lighting mode of the race-use light emitting portions 2 is switched to constant lighting thereafter (F16)

Next, the race-use light emitting portions 2 are turned active in F16, and whether or not all the race-use light emitting portions 2 have turned active is determined (F17). In other words, there is determined whether or not the race-use light emitting portions 2 are turned active all the way to the JP payout indicator 400 along the race line unit 300 in F16. If it is determined that not all the race-use light emitting portions 2 have turned active (F17:NO), there is determined in F7 whether or not JP game has been run for a predetermined period. In F17, if it is determined that all the race-use light emitting portions 2 are turned active (F17:YES), a JP payout is determined based on the "total progressive value" field of the progressive value table illustrated in FIG. 16 (F18). Next, a JP payout signal containing information of the JP payout determined in F18 is transmitted to the gaming terminal 10 having specified in F10 (F19). Then F9 is executed, and the routine ends thereafter.

As described, progressive values input through the coin insertion units 21 or bill insertion units 22 of all the gaming terminals 10 are summed up and stored in the progressive value table illustrated in FIG. 16, which table is stored in the progressive storage unit 207. When the total progressive value stored in the progressive value table illustrated in FIG. 16 exceeds a predetermined value, the JP game is run instead of the base game. Every time a gaming terminal 10 achieves a predetermined JP winning in the JP game having been run, a predetermined number of the race-use light emitting portions 2 forming the race line unit 300 associated with the gaming terminal 10 turned active to blink sequentially from the one closest to the gaming terminal 10, according to the number of the JP winnings having achieved. Meanwhile, in the gaming terminal 10 in which the JP winning has occurred, the cabinet light emitting portions 30 blink in sync with the race-use light emitting portions 2. Then, when race-use light emitting portions 2 of any of the race line units 300 turn active all the way to the JP payout indicator 400 along the race line unit 300, a JP payout is awarded to the associated gaming terminal 10. Activating the race-use light emitting portions 2 based on a result of the JP game provides a new entertainment characteristic that could make players of gaming terminals 10 feel as if they are competing against one another. Further, every time the strip of the activated race-use light emitting portions 2 approaches the JP payout indicator 400, the cabinet light emitting portions 30 of the gaming terminal 10 blink in sync with the race-use light emitting portions 2. This may allow the player to easily grasp the activation status of the associated race-use light emitting portions 2.

Further, the emission color of cabinet light emitting portions 30 and that of the race-use light emitting portions 2 are the same for one gaming terminal 10, but are made different from those for another gaming terminal 10. This may allow each player to easily grasp the activation status of the associated race-use light emitting portions 2. Further, the brightness is adjusted according to the number of the race-use light emitting portions 2 to blink. Accordingly, for example, it is possible that, the larger the number of the race-use light emitting portions 2 blinking, the brighter the race-use light emitting portions 2 blink. This may able players to easily grasp the number of the associated race-use light emitting portions 2 blinking.

The foregoing described an embodiment of the present invention. The present invention, however, is not limited to the embodiment described above.

For example, the above embodiment of the present invention deals with a case where the gaming machine 1 runs the JP game when the total progressive value exceeds a predetermined value, i.e., when the total progressive value stored in the "total progressive value" field of the progressive value table of FIG. 16 exceeds a predetermined value (e.g. 300). However, the present invention is not limited to this. For example, the gaming machine 1 may start the JP game when the total progressive value exceeds a number which randomly varies within a predetermined range of, for example, 200 to 300.

Another embodiment of the invention is also possible, as described below. The following will describe a base game in a gaming machine according to another embodiment of the present invention.

Figure 23:
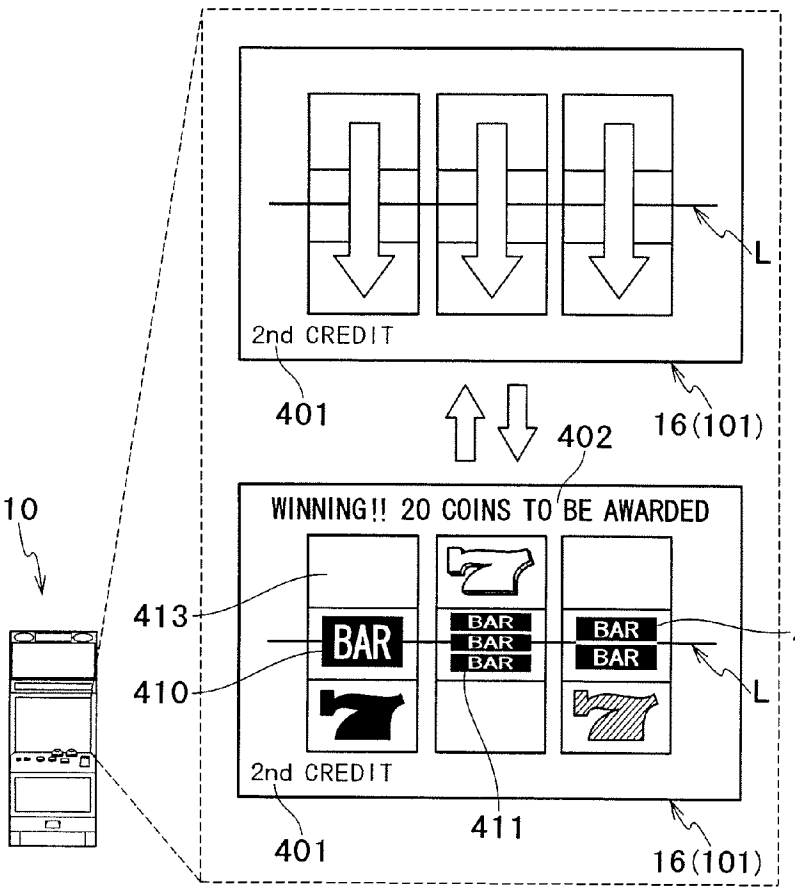
FIG. 23 is an explanatory diagram concerning a base game in a gaming machine according to another embodiment of the present invention.

A terminal display 101 according to another embodiment includes arrangement areas having a matrix of three rows and three columns, as shown in FIG. 23. The arrangement areas in the middle row make up the payline L. When a predetermined winning is achieved by the relation between the symbols rearranged in the payline L, a payout is awarded according to the winning combination. The terminal display 101 displays a credit 401 indicative of the amount of the progressive value bet.

In the example shown in FIG. 23, the credit 401 indicates "2st CREDIT", meaning that the progressive value bet is equivalent of two coins. As a result of symbol rearrangement, symbols 410, 411, and 412 are rearranged as "1BAR", "3BAR", and "2BAR", respectively, in the payline L. These symbols make "ANY-BAR" "ANY-BAR" "ANY-BAR", which is a winning combination for credit 401 equivalent of two coins. As a payout for this winning, twenty coins are awarded.

FIG. 24 illustrates a base game payout table of the other embodiment. The base game payout table is used when the main CPU 41 determines a winning in a base game, and when the main CPU 41 awards a payout according to the winning. The base game payout table includes a bet number field, a winning combination field, and a payout amount field. The bet number field indicates the number of coins having been bet. In the winning combination field, combinations of symbols rearranged in the payline L are shown, which are conditions necessary for meeting a winning. The payout amount field shows the number of coins paid out when a winning is met. This is described below based on the example shown in FIG. 24. When the symbols "3BAR" "3BAR" "3BAR" are rearranged in the payline L, the payout amount is 60 when the number of bet is 1, and 120 when the number of bet is 2. When the symbols "2BAR" "2BAR" "2BAR" are rearranged in the payline L, the payout amount is 40 when the number of bet is 1, and 80 when the number of bet is 2. When the symbols "1BAR" "1BAR" "1BAR" are rearranged in the payline L, the payout amount is 20 when the number of bet is 1, and 40 when the number of bet is 2. When the symbols "ANY-BAR" "ANY-BAR" "ANY-BAR" are rearranged in the payline L, the payout amount is 10 when the number of bet is 1, and 20 when the number of bet is 2. When the symbols "BLANK" "BLANK" "BLANK" are rearranged in the payline L, the payout amount is 1 when the number of bet is 1, and 2 when the number of bet is 2. When the symbols "Blue 7" "Blue 7" "Blue 7" are rearranged in the payline L, the payout amount is 1800 when the number of bet is 3. When the symbols "Red 7" "Red 7" "Red 7" are rearranged in the payline L, the payout amount is 100 when the number of bet is 3. When the symbols "ANY-7" "ANY-7" "ANY-7" are rearranged in the payline L, the payout amount is 100 when the number of bet is 3. In this manner, the payout amount awarded when a winning is achieved increases as the number of bets is increased. This can increase the progressive value (number of bets) made by players.

The following will describe a JP game in a gaming machine according to yet another embodiment of the present invention. In a bonus game according to the yet other embodiment, points are awarded that reflect a predetermined JP winning. A predetermined number of the race-use light emitting portions 2, according to the total value of the points having been awarded, are turned active sequentially towards the JP payout indicator 400.

Figure 25:
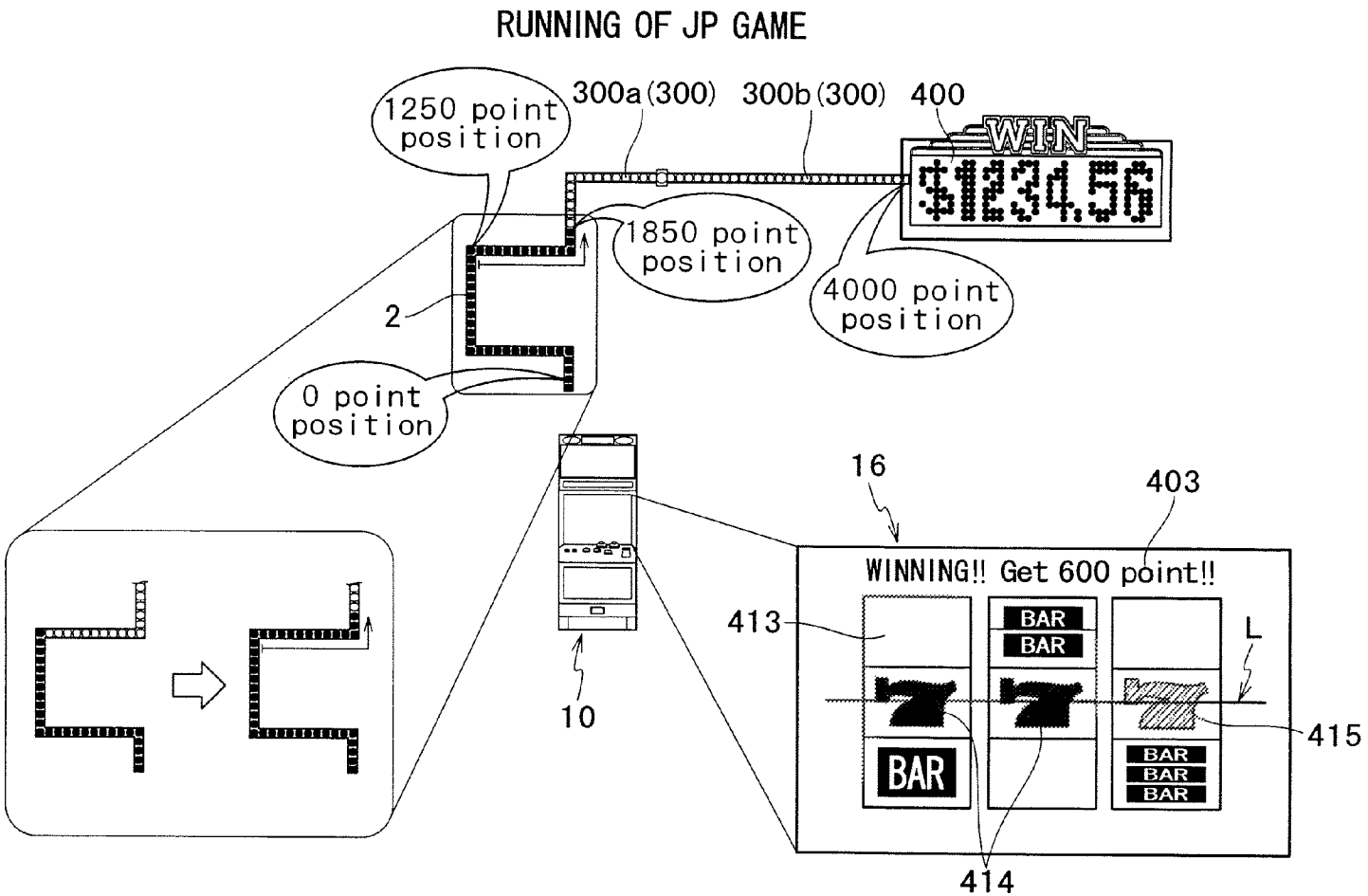
FIG. 25 is an explanatory diagram concerning the JP game in a gaming machine according to the other embodiment of the present invention.

This is described below based on the example shown in FIG. 25. The position corresponding to the gaming terminal 10 has an associated value of 0 point, and the position at the JP payout indicator 400 has an associated value of 4000 points. In the gaming terminal 10, 1250 points have been awarded and accumulated, and the race-use light emitting portions 2 (curve 300*a* and straight part 300*b*) in the race line unit 300 have been activated up to the position corresponding to 1250 points. Here, JP winnings are achieved by the rearrangement of symbol 414 as "Red 7", and symbol 415 as "Red 7", respectively, in the payline L. Three JP winning are met. Rearrangement of one symbol 414 in the payline L makes two JP winnings, and rearrangement of one symbol 415 in the payline L makes another JP winning. The payout for the JP winning achieved by each symbol 414 is 150 points, and the payout for the JP winning achieved by the symbol 415 is 300 points. Accordingly, the three JP winnings make a total payout of 600 points. Awarding 600 points to the gaming terminal 10 makes the cumulative points of 1250+600=1850 points. Then, the race-use light emitting portions 2 are turned active up to a position corresponding to 1850 points. In this manner, during a JP game, points are awarded according to a predetermined JP winning, and a jackpot is awarded when the points accumulate to a predetermined value (4000 points).

FIG. 26 illustrates a JP game payout table of the yet other embodiment. The bonus game payout table is used when the main CPU 41 determines a JP winning in a bonus game, and when the main CPU 241 awards payout points according to the JP winning. The JP game payout table contains a JP winning combination field and payout point field. In the JP winning combination field, combinations of symbols rearranged in the payline L are shown, which are conditions necessary for meeting a winning. The payout point field indicates the number of points paid out when a JP winning is met. This is described below based on the example shown in FIG. 26. When symbols "Blue 7" "Blue 7" "Blue 7" are rearranged in the payline L, 7000 points are paid out. When a symbol "Blue 7" is rearranged in the payline L, 300 points are paid out. When a symbol "Red 7" is rearranged in the payline L, 150 points are paid out. When a symbol "3BAR" is rearranged in the payline L, 30 points are paid out. When a symbol "2BAR" is rearranged in the payline L, 20 points are paid out. When a symbol "1BAR" is rearranged in the payline L, 10 points are paid out.

In yet other embodiment of the present invention, the gaming machine is described that is configured to award a jackpot when the awarded points have accumulated to a predetermined value (4000 points). However, the invention is not limited to this example. For example, the gaming machine may be configured to award a jackpot when the awarded points have accumulated to a value which varies within a predetermined range of, for example, 3000 to 5000, in each JP game.

The detailed description of the present invention provided here in above mainly focused on characteristics thereof for the purpose of easier understanding; however, the scope of the present invention shall be construed as broadly as possible, encompassing various forms of other possible embodiments, and therefore the present invention shall not be limited to the above description. Further, the terms and phraseology used in the present specification are adopted solely to provide specific illustration of the present invention, and in no case should the scope of the present invention be limited by such terms and phraseology. Further, it will be obvious for those skilled in the art that the other structures, systems, methods or the like are possible, within the spirit of the invention described in the present specification. The description of claims therefore shall encompass structures equivalent to the present invention, unless otherwise such structures are regarded as to depart from the spirit and scope of the present invention. Further, the abstract is provided to allow, through a simple investigation, quick analysis of the technical features and essences of the present invention by an intellectual property office, a general public institution, or one skilled in the art who is not fully familiarized with patent and legal or professional terminology. It is therefore not an intention of the abstract to limit the scope of the present invention which shall be construed on the basis of the description of the claims. To fully understand the object and effects of the present invention, it is strongly encouraged to sufficiently refer to disclosures of documents already made available.

The detailed description of the present invention provided hereinabove includes a process executed on a computer or computer network. The above descriptions and expressions are provided to allow the one skilled in the art to most efficiently understand the present invention. A process performed in or by respective steps yielding one result or blocks with a predetermined processing function described in the present specification shall be understood as a process with no self-contradiction. Further, the electrical or magnetic signal is transmitted/received and written in the respective steps or blocks. It should be noted that such a signal is expressed in the form of bit, value, symbol, text, terms, number, or the like solely for the sake of convenience. Although the present specification occasionally personifies the processes performed in the steps or blocks, these processes are essentially executed by various devices. Further, the other structures necessary for the steps or blocks are obvious from the above descriptions.

What is claimed is:

1. A gaming apparatus for executing a base game and a special game which evolves from the base game, comprising:

a plurality of gaming terminals respectively having first light emitting portions and game value input ports, the first light emitting portions each providing an effect to the base game and the special game, and the game value input ports each receiving an input of a game value used as a resource of a payout for the special game;

a shared display which displays a special payout of the special game run by the gaming terminals;

a plurality of routes formed by arranging second light emitting portions from the respective gaming terminals to the shared display;

a game value storage unit which stores the input game value through the game value input port of any of the gaming terminals; and a controller which performs the steps of:

(a1) when running the base game at each of the gaming terminals, storing a sum of at least a part of the input game value through the game value input port of each of the gaming terminals in the game value storage unit, as the special payout in the special game;

(a2) displaying, on the shared display, the special payout in the special game, which is stored in the game value storage unit in the step (a1);

(a3) when the sum of the game value stored in the game value storage unit exceeds a predetermined value, shifting the base game to the special game in each of the gaming terminals;

(a4) when a predetermined condition is established in the special game, blinking the first light emitting portions of at least one of the gaming terminals having established the predetermined condition;

(a5) after blinking the first light emitting portions in the step (a4), blinking on the route corresponding to the gaming terminal having established the predetermined condition, a predetermined number of the second light emitting portions from the gaming terminal side toward the shared display, in sync with the first light emitting portions of the gaming terminal having established the predetermined condition, the predetermined number corresponding to the predetermined condition, and then turning on the second light emitting portions; and (a6) after repeating the steps (a4) and (a5), awarding the special payout to the gaming terminal whose second light emitting portions on the route reach the shared display first among the gaming terminals.

2. The gaming apparatus according to claim 1, wherein:

the first light emitting portions of the gaming terminal and the second light emitting portions forming the route associated with the gaming terminal blink in the same emission color; and the emission color is made different for each of the gaming terminals.

3. The gaming apparatus according to claim 1, wherein:

when the second light emitting portions are activated to blink, the controller adjusts the brightness of the second light emitting portions according to the number of the second light emitting portions to blink.

4. The gaming apparatus according to claim 1, wherein:

the first light emitting portions of the gaming terminal and the second light emitting portions forming the route associated with the gaming terminal blink in the same emission color;

the emission color is made different for each of the gaming terminals; and when the second light emitting portions are activated to blink, the controller adjusts the brightness of the second light emitting portions according to the number of the second light emitting portions to blink.

5. A playing method for a gaming apparatus executing a base game and a special game which evolves from the base game, the gaming apparatus including:

a plurality of gaming terminals respectively having first light emitting portions and game value input ports, the first light emitting portions each providing an effect to the base game and the special game, and the game value input ports each receiving an input of a game value used as a resource of a payout for the special game;

a shared display which displays a special payout of the special game run by the gaming terminals;

a plurality of routes formed by arranging second light emitting portions from the respective gaming terminals to the shared display;

a game value storage unit which stores the input game value through the game value input port of any of the gaming terminals; and a controller;

the method comprising the steps of:

under the control of the controller, (a1) when running the base game at each of the gaming terminals, storing a sum of at least a part of the input game value through the game value input port of each of the gaming terminals in the game value storage unit, as the special payout in the special game;

(a2) displaying, on the in the special game, which is stored in the game value storage unit in the step (a1);

(a3) when the sum of the game value stored in the game value storage unit exceeds a predetermined value, shifting the base game me in each of the gaming terminals;

(a4) when a predetermined condition is established in the special game, blinking the first light emitting portions of at least one of the gaming terminals having established the predetermined condition;

(a5) after blinking the first light emitting portions in the step (a4), blinking, on the route corresponding to gaming terminal having established the predetermined condition, a predetermined number of the second light emitting portions from the gaming terminal side toward the shared display, in sync with the first light emitting portions of the gaming terminal having established the predetermined condition, the predetermined number corresponding to the predetermined condition, and then turning on the second light emitting portions; and (a6) after repeating the steps (a4) and (a5), awarding the special payout of the gaming terminal whose second light emitting portions on the route reach the shared display first among the gaming terminals.

6. The gaming apparatus according to claim 1, wherein:

the routes from each of the gaming terminals to the shared display have at least one curve.

* * * * *